United States Patent [19]

Kudo et al.

[11] 4,421,571

[45] Dec. 20, 1983

[54] PROCESS FOR MAKING HIGH STRENGTH DEEP WELL CASING AND TUBING HAVING IMPROVED RESISTANCE TO STRESS-CORROSION CRACKING

[75] Inventors: Takeo Kudo, Suita; Yasutaka Okada, Nishinomiya; Taishi Moroishi, Kobe; Akio Ikeda, Hyogo; Hiroo Ohtani, Kobe; Kunihiko Yoshikawa, Suita, all of Japan

[73] Assignee: Sumitomo Metal Industries, Ltd., Osaka, Japan

[21] Appl. No.: 389,568

[22] Filed: Jun. 17, 1982

[30] Foreign Application Priority Data

| | | | |
|---|---|---|---|
| Jul. 3, 1981 | [JP] | Japan | 56-104111 |
| Jul. 3, 1981 | [JP] | Japan | 56-104112 |
| Jul. 3, 1981 | [JP] | Japan | 56-104113 |
| Jul. 10, 1981 | [JP] | Japan | 56-106913 |
| Jul. 10, 1981 | [JP] | Japan | 56-106914 |
| Jul. 10, 1981 | [JP] | Japan | 56-106915 |
| Jul. 13, 1981 | [JP] | Japan | 56-108985 |
| Jul. 13, 1981 | [JP] | Japan | 56-108986 |
| Jul. 13, 1981 | [JP] | Japan | 56-108987 |

[51] Int. Cl.[3] ..... C22C 19/05

[52] U.S. Cl. ..... 148/11.5 R; 148/11.5 N; 148/12.7 N; 420/448; 420/452

[58] Field of Search ..... 148/11.5 N, 11.5 R, 148/12.4, 12.7 N, 12.7 R; 420/448, 452

[56] References Cited

U.S. PATENT DOCUMENTS

| | | | |
|---|---|---|---|
| 4,168,188 | 9/1979 | Asphahani | 148/11.5 N |
| 4,171,217 | 10/1979 | Asphahani et al. | 148/12.7 N |
| 4,245,698 | 1/1981 | Berkowitz et al. | 148/11.5 N |

*Primary Examiner*—W. Stallard

*Attorney, Agent, or Firm*—Burns, Doane, Swecker & Mathis

[57] ABSTRACT

A process for manufacturing high strength deep well casing, tubing, and drill pipes, which have improved resistance to stress corrosion cracking is disclosed. The process comprises the steps of preparing an alloy composition which is:

| | | | |
|---|---|---|---|
| C | ≦0.05% | Si | ≦1.0% |
| Mn | ≦2.0% | P | ≦0.030% |
| S | ≦0.005% | N | 0–0.30% |
| Ni | 25–60% | Cr | 15–35% |
| Mo | 0–12% | W | 0–24% |
| Cr (%) + 10Mo (%) + 5W (%) ≧ 50% | | | |
| 1.5% ≦ Mo (%) + ½W (%) ≦ 12% | | | |
| Cu | 0–2.0% | Co | 0–2.0% |
| Rare Earths | 0–0.10% | Y | 0–0.20% |
| Mg 0–0.10% | Ti 0–0.5% | Ca 0–0.10% | |
| and incidental impurities | | balance; | |

applying, after hot working, the solid solution treatment to the alloy at a temperature of from the lower limit temperature (°C.) defined by the following empirical formula: 260 log C(%)+1300 to the upper limit temperature (°C. ) defined by the following empirical formula: 16Mo(%)+10W(%)+10Cr(%)+777 for a period of time of not longer than 2 hours; and applying cold working to the resulting alloy with a reduction in thickness of 10–60%. The hot working may be carried out with a reduction in thickness of 10% or more for the temperature range of not higher than the recrystallizing temperature thereof.

18 Claims, 5 Drawing Figures

BATH TEMP. : 150°C

BASIC ALLOY COMPOSITION :

| C | Si | Mn | P | S | N |
|---|---|---|---|---|---|
| 0.01 | 0.2 | 0.6 | 0.010 | 0.001 | 0.12 |

BATH TEMP. : 200°C

BASIC ALLOY COMPOSITION:

| C | Si | Mn | P | S | N |
|---|---|---|---|---|---|
| 0.01 | 0.3 | 0.6 | 0.010 | 0.001 | 0.15 |

BATH TEMP. : 300°C

BASIC ALLOY COMPOSITION:

| C | Si | Mn | P | S | N |
|---|---|---|---|---|---|
| 0.01 | 0.3 | 0.6 | 0.010 | 0.0007 | 0.04 |

PROCESS FOR MAKING HIGH STRENGTH DEEP WELL CASING AND TUBING HAVING IMPROVED RESISTANCE TO STRESS-CORROSION CRACKING

This invention relates to a process for making deep well casing and/or tubing having high strength as well as improved resistance to stress corrosion cracking and is especially useful for manufacturing casing, tubing and drill pipes for use in deep wells for producing oil, natural gas, or geothermal water (hereunder referred to as "deep well" collectively).

Recently, in exploring for and reaching new sources of oil and natural gas, wells are being drilled deeper and deeper. Oil-wells 6000 meters or more are no longer unusual, and oil-wells 10,000 meters or more deep have been reported.

A deep well, therefore, is inevitably exposed to a severe environment. In addition to the high pressure, the environment of a deep well contains corrosive materials such as carbon dioxide and chlorine ions as well as wet hydrogen sulfide under high pressure.

Thus, casing, tubing and drill pipes (hereunder referred to as "casing and tubing", which mean, in general, oil country tubular goods) for use in oil-wells under such severe conditions must have high strength and improved resistance to stress corrosion cracking. In a general aspect, as one of the known measures used to prevent oil-well casing and/or tubing from stress corrosion cracking, it has been known in the art that a corrosion-suppressing agent called "inhibitor" is injected into the well. However, this measure to prevent corrosion cannot be used in all cases; for example it is not applicable to offshore oil-wells.

Therefore, recently the use of a high-grade corrosion-resistant, high-alloy steel such as stainless steels, Incoloy (tradename) and Hastelloy (tradename) has been tried. However, the behavior of such materials under a corrosive environment including $H_2S$-$CO_2$-$Cl^-$ system like that found in deep oil-wells has not been studied thoroughly up to now.

U.S. Pat. No. 4,168,188 to Asphahani discloses a nickel base alloy containing 12–18% of molybdenum, 10–20% of chromium and 10–20% of iron for use in manufacturing well pipes and tubing. U.S. Pat. No. 4,171,217 to Asphahani et al also discloses a similar alloy composition in which this time the carbon content is limited to 0.030% maximum. U.S. Pat. No. 4,245,698 to Berkowitz et al discloses a nickel base superalloy containing 10–20% of molybdenum for use in sour gas or oil wells.

The object of this invention is to provide a process for manufacturing deep well casing and tubing which will have sufficient strength and high enough resistance to stress corrosion cracking to endure deep well drilling and/or a severely corrosive environment, especially that including $H_2S$-$CO_2$-$Cl^-$ system (hereunder referred to as "$H_2S$-$CO_2$-$Cl^-$-containing environment", or merely as "$H_2S$-$CO_2$-$Cl^-$-environment").

Figure 1:
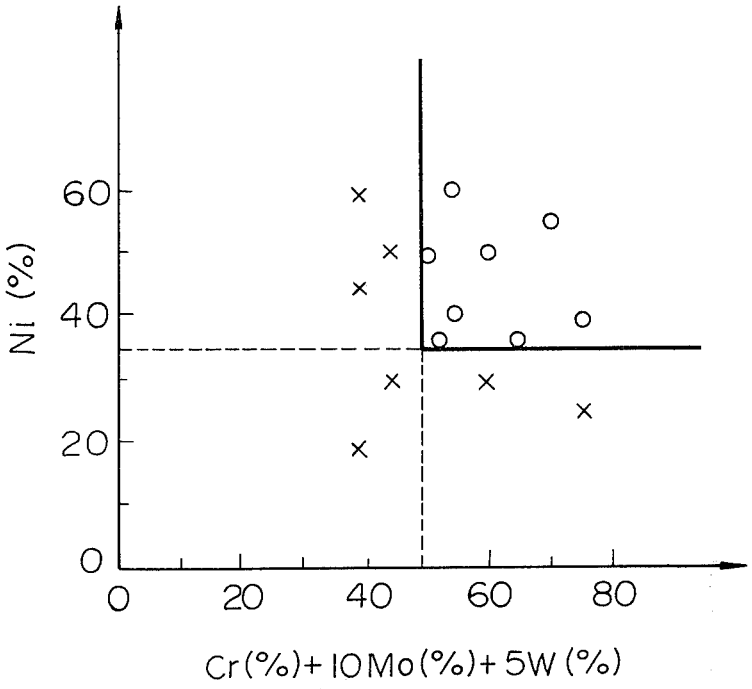
FIGS. 1 through 3 show the relationship between the Ni content and the value of the equation: $Cr(\%)+10Mo(\%)+5W(\%)$ with respect to the resistance to stress corrosion cracking at the respective bath temperatures indicated.

In the course of our research we found the following:

(a) Under corrosive environments containing $H_2S$, $CO_2$ and chloride ions ($Cl^-$), corrosion proceeds mainly by way of stress corrosion cracking. The mechanism of stress corrosion cracking in those cases, however, is quite different from that generally found in austenitic stainless steels. That is, the primary cause of the stress corrosion cracking in the case of austenitic stainless steel is the presence of chloride ions ($Cl^-$). In contrast, the primary cause of such stress corrosion cracking as found in casing and/or tubing in deep oil-wells, is the presence of $H_2S$, although the presence of $Cl^-$ ions is also a factor.

(b) Alloy casing and tubing to be used in deep oil-wells are usually subjected to cold working in order to improve strength. However, cold working seriously decreases the resistance to stress corrosion cracking.

(c) The corrosion rate of an alloy in a corrosive $H_2S$-$CO_2$-$Cl^-$-environment depends on the Cr, Ni, Mo and W content of the alloy. If the casing or tubing has a surface layer comprised of these elements, the alloy not only has better resistance to corrosion in general, but also it has improved resistance to stress corrosion cracking even under the corrosive environment found in deep oil wells. Specifically as to the resistance against stress corrosion cracking, we found that molybdenum is 10 times as effective as chromium, and molybdenum is twice as effective as tungsten. Thus, we found chromium (%), tungsten (%) and molybdenum (%) are satisfied by the equations:

$$Cr(\%)+10Mo(\%)+5W(\%)\geqq 50\%$$

$$1.5\%\leqq Mo(\%)+\tfrac{1}{2}W(\%)<4\%$$

In addition, the Ni content is within the range of 35–60% and the chromium content is within the range of 22.5–35%. Then even after having been subjected to cold working, the resulting alloy surface layer retains markedly improved resistance to corrosion in a $H_2S$-$CO_2$-$Cl^-$-environment, particularly one containing concentrated $H_2S$ at a temperature of 150° C. or less.

When the alloy is used in an extremely corrosive $H_2S$-$CO_2$-$Cl^-$ environment as in deep oil wells, especially at a temperature of 200° C. or less, it is desirable that the proportions of chromium (%), tungsten (%) and molybdenum (%) be satisfied by the equations:

$$Cr(\%)+10Mo(\%)+5W(\%)\geqq 70\%$$

$$4\%\leqq Mo(\%)+\tfrac{1}{2}W(\%)<8\%$$

and the Ni content is within the range of 25–60% and the Cr content is within the range of 22.5–30%.

In addition, when the alloy is used in an extremely corrosive $H_2S$-$CO_2$-$Cl^-$ environment as in deep oil wells, especially at a temperature of 200° C. or higher, the proportions of chromium (%), tungsten (%) and molybdenum (%) are satisfied by the equations:

$$Cr(\%)+10Mo(\%)5W(\%)\geqq 110\%$$

$$8\%\leqq Mo(\%)+\tfrac{1}{2}W(\%)\leqq 12\%$$

and the Ni content is within the range of 30–60% and the Cr content is within the range of 15–30%.

(d) The addition of nickel is effective not only to improve the resistance of the surface layer to stress corrosion cracking, but also to improve the metallurgical structure itself of the alloy. Thus, the addition of nickel results in markedly improved resistance to stress corrosion cracking.

(e) When nitrogen in an amount within the range of 0.05–0.30% is intentionally added to the alloy as an alloying element, the strength of the resulting alloy is further improved without any reduction in corrosion resistance. A preferred nitrogen content is from 0.05–0.25%.

(f) Sulfur is an incidental impurity, and when the S content is not more than 0.0007%, hot workability of the resulting alloy is markedly improved.

(g) Phosphorous, too, is an incidental impurity, and when the P content is not more than 0.003%, the susceptibility to hydrogen embrittlement is markedly reduced.

(h) When Cu in an amount of not more than 2.0% and/or Co in an amount of not more than 2.0% is added to the alloy as additional alloying elements, the resistance to corrosion is further improved.

(i) When one or more of the following alloying elements is added to the alloy in the proportion indicated, the hot workability is further improved: rear earths, not more than 0.1%; Y, not more than 0.2%; Mg, not more than 0.10%; Ti, not more than 0.5%; and Ca, not more than 0.10%.

(j) In order to obtain a desired level of strength, the alloys having such compositions as mentioned above are preferably subjected to solid solution treatment at a temperature of from the lower limit temperature (°C.) defined by the following empirical formula: 260 log C(%)+1300 to the upper limit temperature (°C.) defined by the following empirical formula: 16Mo(%)+10W(%)+10Cr(%)+777 for a period of time of not longer than 2 hours to completely dissolve the carbides therein, and then subjected to cold working with a reduction in thickness of from 10–60%.

(k) In order to obtain a desired level of strength, it is also preferable that the alloys having such alloy compositions mentioned above be subjected to solid solution treatment preferably at a temperature of 1050°–1250° C. so that intermetallic compounds and carbides may all be dissolved, and then subjected to hot working with the reduction in thickness for the temperature range of not higher than the recrystallizing temperature thereof being 10% or more. The purpose of the hot working is to assure that the succeeding heat treatment can provide recrystallized fine grains, which result in a high degree of strength and good ductility. Then, the alloy is subjected to solid solution treatment at a temperature of from the lower limit temperature (°C.) defined by the following empirical formula: 260 log C(%)+1300 to the upper limit temperature (°C.) defined by the following empirical formula: 16Mo(%)+10W(%)+10Cr(%)+777 for a period of time of not longer than 2 hours to provide such recrystallized fine grains as mentioned above and simultaneously to dissolve precipitated carbides, if any, resulting in highly improved resistance to corrosion. Lastly, the thus heat-treated alloys are subjected to cold working with a reduction in thickness of 10–60% contributing to the work hardening.

(l) Furthermore, in order to obtain a further desirable level of strength, the alloys mentioned above may be subjected to solid solution treatment preferably at a temperature of 1050°–1250° C. to dissolve intermetallic compounds and carbides thoroughly, and then the alloys may be subjected to hot working with a reduction in thickness of 10% or more for the temperature range of not higher than 1000° C., and the finishing temperature being 800° C. or higher. Thus, the precipitation of intermetallic compounds and carbides which would result in deterioration in corrosion-resistant properties of the alloy may successfully be avoided to provide fine crystal grains. Thus, a high level of strength and ductility can be obtained due to the formation of such fine crystal grains. Then, the alloys are subjected to cold working with a reduction in thickness of 10–60% so as to achieve work hardening.

This invention has been completed on the basis of the discoveries mentioned above, and resides in a process for manufacturing high strength deep well casing and tubing having improved resistance to stress corrosion cracking. The alloy composition to be employed in this invention is preferably selected from the group consisting of:

(I)

C: not more than 0.05%,
Si: not more than 1.0%,
Mn: not more than 2.0%,
P: not more than 0.030%, preferably not more than 0.003%,
S: not more than 0.005%, preferably not more than 0.0007%,
Ni: 35–60%,
Cr: 22.5–35%, preferably 24–35%,
one or more of Mo: less than 4%, and
W: less than 8%,
with the following equations being satisfied:

$$Cr(\%)+10Mo(\%)+5W(\%)\geqq 50\%, \text{ and}$$

$$1.5\% \leqq Mo(\%)+\tfrac{1}{2}W(\%)\ 4\%$$

and the balance iron with incidental impurities;

(II)

C: not more than 0.05%,
Si: not more than 1.0%,
Mn: not more than 2.0%,
P: not more than 0.030%, preferably not more than 0.003%,
S: not more than 0.005%, preferably not more than 0.0007%,
Ni: 25–60%, preferably 35–60%,
Cr: 22.5–30%, preferably 24–30%,
one or more of Mo: less than 8%, and
W: less than 16%,
with the following equations being satisfied:

$$Cr(\%)+10Mo(\%)+5W(\%)\geqq 70\%, \text{ and}$$

$$4\% \leqq Mo(\%)+\tfrac{1}{2}W(\%)<8\%$$

and the balance iron with incidental impurities; and (III)

C: not more than 0.05%,
Si: not more than 1.0%,
Mn: not more than 2.0%,
P: not more than 0.030%, preferably not more than 0.003%, S: not more than 0.005%, preferably not more than 0.0007%,
Ni: 30–60%, preferably 40–60%,
Cr: 15–30%,
one or more of Mo: not more than 12%, and
W: not more than 24%,
with the following equations being satisfied:

$$Cr(\%)+10Mo(\%)+5W(\%)\geqq 110\%, \text{ and}$$

$$8\%\leqq Mo(\%)+\tfrac{1}{2}W(\%)\leqq 12\%$$

and the balance iron with incidental impurities.

The alloy of this invention may further comprise any combination of the following:

(i) Cu, not more than 2.0%, and/or Co, not more than 2.0%.

(ii) One or more of rare earths, not more than 0.10%; Y, not more than 0.20%; Mg, not more than 0.10%; Ti, not more than 0.5%; and Ca, not more than 0.10%.

(iii) Nitrogen in an amount of 0.05–0.30%, preferably 0.05–0.25% may be intentionally added to the alloy.

Thus, according to this invention, an alloy having such an alloy composition as mentioned above is, after hot working, subjected to solid solution treatment at a temperature of from the lower limit temperature (°C.) defined by the following empirical formula: 260 log C(%)+1300 to the upper limit temperature (°C.) defined by the following empirical formula: 16Mo(%)+10W(%)+10Cr(%)+777 for a period of time of not longer than 2 hours to dissolve the carbides therein, and then subjected to cold working with a reduction in thickness of 10–60%.

In another embodiment of this invention, the alloy is subjected to hot working with a reduction in thickness of 10% or more for the temperature range of not higher than the recrystallizing temperature thereof; then the resulting alloy is subjected to solid solution treatment at a temperature of from the lower limit temperature (°C.) defined by the following empirical formula:

$$260\log C(\%)+1300$$

to the upper limit temperature (°C.) defined by the following empirical formula:

$$16Mo(\%)+10W(\%)+10Cr(\%)+777$$

for a period of time of not longer than 2 hours, and the thus heat-treated alloy is subjected to cold working with a reduction in thickness of 10–60%. Preferably, prior to the hot working, the alloy may be subjected to solid solution treatment at a temperature of from 1050°–1250° C.

In still another embodiment, the alloy is subjected to hot working with a reduction in thickness of 10% or more for the temperature range of not higher than 1000° C., and the finishing temperature being 800° C. or higher, and then the alloy is subjected to cold working with a reduction in thickness of 10–60%. Preferably, prior to the hot working, the alloy may be subjected to solid solution treatment at a temperature of from 1050°–1250° C.

Therefore, in a broad aspect, this invention resides in a process for manufacturing high strength deep well casing and tubing having improved resistance to stress corrosion cracking, which comprises the steps of preparing an alloy having the alloy composition which comprises:

| | | | |
|---|---|---|---|
| C | ≦0.05% | Si | ≦1.0% |
| Mn | ≦2.0% | P | ≦0.030% |
| S | ≦0.005% | N | 0–0.30% |
| Ni | 25–60% | Cr | 15–35% |
| Mo | 0–12% | W | 0–24% |
| Cr (%) + 10Mo (%) + 5W (%) ≧ 50% | | | |
| 1.5% ≦ Mo (%) + ½W (%) ≦ 12% | | | |
| Cu | 0–2.0% | Co | 0–2.0% |
| Rare Earths | 0–0.10% | Y | 0–0.20% |
| Mg 0–0.10% | Ti 0–0.5% | Ca 0–0.10% | |
| and incidental impurities | | balance; | |

applying, after hot working, the solid solution treatment to the alloy at a temperature of from the lower limit temperature (°C.) defined by the following empirical formula: 260 log C(%)+1300 to the upper limit temperature (°C.) defined by the following empirical formula: 16Mo(%)+10W(%)+10Cr(%)+777 for a period of time of not longer than 2 hours; and applying cold working to the resulting alloy with a reduction in thickness of 10–60%.

In another embodiment, the process of this invention comprises applying hot working to the alloy prior to said solid solution treatment with a reduction in thickness of 10% or more for the temperature range of not higher than the recrystallizing temperature thereof, and then applying said solid solution treatment and cold working in the same manner. Preferably, prior to the hot working, the alloy may be subjected to heating at a temperature of from 1050° to 1250° C.

In still another embodiment, the process of this invention comprises applying hot working to the alloy with a reduction in thickness of 10% or more for the temperature range of not higher than 1000° C. and the finishing temperature being 800° C. or higher, and applying cold working to the resulting hot worked alloy with a reduction in thickness of 10–60%. Preferably, prior to either hot working or cold working, a solid solution treatment may be applied. In this respect, the solid solution treatment to be carried out at a temperature of from the lower limit temperature (°C.) defined by the following empirical formula: 260 log C(%)+1300 to the upper limit temperature (°C.) defined by the following empirical formula: 16Mo(%)+10W(%)+10Cr(%)+777 for a period of time of not longer than 2 hours should be applied prior to the cold working when such solid solution treatment is employed.

Now, the reasons for defining the alloy composition of this invention as in the above will be described.

Carbon (C):

The lower the C content, the less the precipitation of carbides. Therefore, when the C content is low, it is possible to lower the level of heating temperature before the hot working so much that a large extent of increase in strength after cold working can be expected. It is desirable to keep the C content as low as possible. In this respect, when the carbon content is over 0.05%, the alloy is rather susceptible to stress corrosion cracking. The upper limit thereof is 0.05%.

Silicon (Si):

Si is a necessary element as a deoxidizing agent. However, when it is more than 1.0%, hot workability of the resulting alloy deteriorates. The upper limit thereof is defined as 1.0%.

Manganese (Mn):

Mn is also a deoxidizing agent like Si. It is to be noted that the addition of Mn has substantially no effect on the resistance to stress corrosion cracking. Thus, the upper limit thereof has been restricted to 2.0%.

Phosphorous (P):

P is present in the alloy as an impurity. The presence of P in an amount of more than 0.030% causes the resulting alloy to be susceptible to hydrogen embrittlement. Therefore, the upper limit of P is defined as 0.030%, so that susceptibility to hydrogen embrittlement may be kept at a lower level. It is to be noted that when the P content is reduced beyond the point of 0.003%, the susceptibility to hydrogen embrittlement is drastically improved. Therefore, it is highly desirable to reduce the P content to 0.003% or less when it is desired to obtain an alloy with remarkably improved resistance to hydrogen embittlement.

Sulfur (S):

When the amount of S, which is present in alloy as an incidental impurity, is over 0.005%, the hot workability deteriorates. So, the amount of S in alloy is restricted to not more than 0.005% in order to prevent deterioration in hot workability. When the amount of S is reduced to 0.0007% or less, the hot workability is dramatically improved. Therefore, where hot working under severe conditions is required, it is desirable to reduce the S content to 0.0007% or less.

Aluminum (Al):

Al, like Si and Mn, is effective as a deoxidizing agent. In addition, since Al does not have any adverse effect on properties of the alloy, the presence of Al in an amount of up to 0.5%, as sol. Al may be allowed.

Nickel (Ni):

Ni is effective to improve the resistance to stress corrosion cracking. When nickel is added in an amount of less than 25%, however, it is impossible to impart a sufficient degree of resistance to stress corrosion cracking. On the other hand, when it is added in an amount of more than 60%, the resistance to stress corrosion cracking cannot be further improved. Thus, in view of economy of material the nickel content is restricted to 25–60% in its broad aspect. The nickel content is preferably from 40–60% in order to further improve toughness.

Chromium (Cr):

Cr is effective to improve the resistance to stress corrosion in the presence of Ni, Mo and W. However, less than 15% of Cr does not contribute to improvement in hot workability, and it is necessary to add such other elements as Mo and W in order to keep a desired level of resistance to stress corrosion cracking. From the viewpoint of economy, therefore, it is not desirable to reduce the amount of Cr so much. The lower limit of the Cr content is defined as 15%. On the other hand, when Cr is added in an amount of more than 35%, hot workability deteriorates, even when the amount of S is reduced to less than 0.0007%.

Molybdenum (Mo) and Tungsten (W):

As already mentioned, both elements are effective to improve the resistance to stress corrosion cracking in the presence of Ni and Cr. However, generally speaking, when Mo and W are respectively added in amounts of more than 12% and more than 24%, the corrosion resistance properties cannot be improved any more under the $H_2S$-$CO_2$-$Cl^-$ environment. More particularly, the addition of Mo and W in amounts of more than 12% and more than 24%, respectively does not result in any additional improvement at a temperature of 200° C. or higher; more than 8% and more than 16%, respectively, at a temperature of 200° C. or lower; and more than 4% and more than 8%, respectively at a temperature of 150° C. or lower. Therefore, by considering the economy of material, Mo may be added in an amount of not more than 12%, or less than 8%, or less than 4%, and W may be added in an amount of not more than 24%, or less than 16%, or less than 8% depending on the severity of the corrosive environment in which the casing and/or tubing produced in accordance with this invention is used.

Regarding the Mo and W content, we have introduced the equation: $Mo(\%)+\frac{1}{2}W(\%)$. This is because, since the atomic weight of W is twice the atomic weight of Mo, Mo is twice as effective as W with respect to improvement in the resistance to stress corrosion cracking.

When the value of this equation is less than 8%, it is impossible to obtain the desired level of resistance to stress corrosion cracking, particularly at a temperature of 200° C. or higher under the severe $H_2S$-$CO_2$-$Cl^-$ environment. On the other hand, when the value is larger than 12%, this means that an excess of Mo or W has been added and this is not desirable from the viewpoint of economy.

When the value of this equation is less than 4.0%, it is impossible to obtain the desired level of resistance to stress corrosion cracking at a temperature of 200° C. or lower under the severe environment. On the other hand, when the value is not smaller than 8%, this means that an excess of Mo or W has been added and this is not desirable from the viewpoint of conomy in such a severe environment at a temperature of 200° C. or lower.

When the value of this equation is less than 1.5%, it is impossible to obtain the desired level of resistance to stress corrosion cracking at a temperature of 150° C. or lower under the severe environment. On the other hand, when the value is larger than 4.0%, this means that an excess of Mo or W has been added and this is not desirable from the viewpoint of economy in such a corrosive environment at a temperature of 150° C. or lower.

Nitrogen (N):

When N is intentionally added to the alloy, N is effective to improve the strength of the resulting alloy due to solid solution hardening without reducing the resistance to stress corrosion cracking. When the N content is less than 0.05%, it is not effective to impart a desired level of strength to the alloy. On the other hand, it is rather difficult to prepare the melt and ingot of the alloy, if N is added in an amount of more than 0.30%. Thus, according to this invention, the N content, when it is added, is defined as within the range of 0.05–0.30%, preferably 0.05–0.25%.

Copper (Cu) and Cobalt (Co):

Cu and Co are effective to improve corrosion resistance of the alloy used in this invention. Therefore, Cu and/or Co may be added when especially high corrosion resistance is required. However, the addition of Cu in an amount of more than 2.0% tends to lower the hot workability. The addition of Co in an amount of more than 2.0% does not provide any additional improvement. The upper limit each of them is 2.0%.

Rare Earths, Y, Mg, Ti and Ca:

They are all effective to improve hot workability. Therefore, when the alloy has to be subjected to severe hot working, it is desirable to incorporate at least one of these elements in the alloy. However, when rear earths in an amount of more than 0.10%, or Y more than 0.20%, or Mg more than 0.10%, or Ti more than 0.5%, or Ca more than 0.10% is added, there is no substantial improvement in hot workability. Rather, deterioration in hot workability is sometimes found.

Thus, the addition of these elements is limited to not more than 0.10%, for rare earths, 0.20% for Y, 0.10% for Mg, 0.5% for Ti and 0.10% for Ca.

Furthermore, according to this invention, the amounts of Cr, Mo and W are also restricted by the following equation:

$$Cr(\%)+10Mo(\%)+5W(\%)$$

Figure 2:
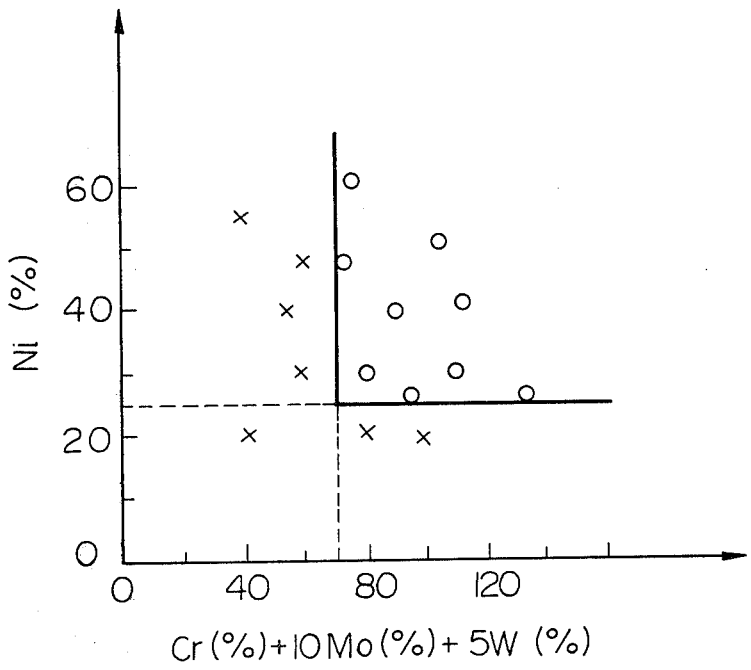
Figure 3:
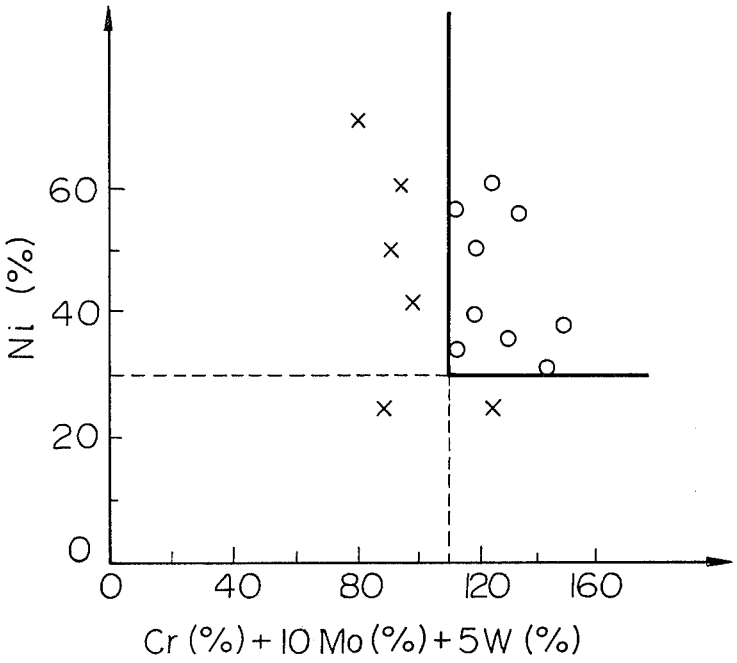

FIGS. 1-3 show the relationship between Cr(%)+10Mo(%)+5W(%) and Ni(%) with respect to the resistance to stress corrosion cracking under severe corrosive conditions.

In order to obtain the data shown in FIG. 1, a series of Cr-Ni-Mo alloys, Cr-Ni-W alloys and Cr-Ni-Mo-W alloys, in each of which the proportions of Cr, Ni, Mo and W were varied, were prepared, cast, forged and hot rolled to provide alloy plates 7 mm thick. The resulting plates were thereafter subjected to solid solution treatment at 1000° C. for 30 minutes and then water-cooled. After finishing the solid solution treatment cold working was applied with a reduction in thickness of 22% in order to improve its strength. Specimens (2 mm thickness×10 mm width×75 mm length) were cut from the cold rolled sheet in the direction perpendicular to the rolling direction.

Figure 4:
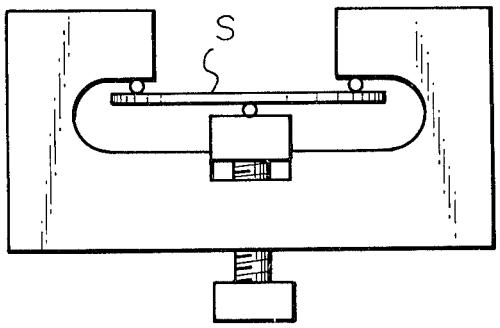
FIG. 4 is a schematic view of a specimen held by a three-point supporting beam-type jig.

Each of these specimens was held on a three-point supporting beam-type jig as shown in FIG. 4. Thus, the specimen S under tension at a level of a tensile strength corresponding to 0.2% offset yield strength was subjected to the stress corrosion cracking test. Namely, the specimen together with said jig were soaked in a 20% NaCl solution (bath temperature 150° C.) saturated by $H_2S$ and $CO_2$ at a pressure of 10 atms, respectively, for 1000 hours.

After soaking for 1000 hours, the formation of cracks was visually examined. The resulting data indicates that there is a definite relationship, as shown in FIG. 1, between Ni(%) and the equation: Cr(%)+10Mo(%)+5W(%), which is a parameter first conceived by the inventors of this invention, with respect to the resistance to stress corrosion cracking.

The above procedure was repeated except that:

Said series of alloys were prepared, cast, forged to provide slabs 50 mm thick, which were then hot rolled at 1200° C. The thickness of the slab was reduced to 10 mm while the temperature lowered to 1000° C. After this point, recrystallization does not usually occur. Then the slabs were further hot rolled to a thickness of 7 mm with a reduction in thickness of 30% at temperatures of 1000° C. or lower to provide hot rolled plates 7 mm thick. The bath temperature of said 20% NaCl solution was 200° C. The resulting data are summarized in FIG. 2.

Next, said hot rolling of slabs was carried out with a reduction in thickness of 30% within the temperature range of from 1000° C. to 900° C., which was the finishing temperature of the hot rolling. The bath temperature of said 22% NaCl solution was 300° C. The resulting data are summarized in FIG. 3.

In FIGS. 1-3, the symbol "O" shows the case in which there was no substantial cracking and "X" indicates the occurrence of cracking. As is apparent from the data shown in FIGS. 1-3, alloy articles manufactured in accordance with this invention exhibit markedly improved resistance to stress corrosion cracking under severe conditions.

The alloy composition to be employed in this invention may include as incidental impurities B, Sn, Pb, Zn, etc. each in an amount of less than 0.1% without rendering any adverse effect on the properties of the alloy.

According to this invention, a satisfactory level of strength of the casing and tubing is obtained not only by optimizing the alloy composition but also by applying cold working after thoroughly dissolving the precipitated carbides.

In one aspect of this invention, the carbides are thoroughly dissolved by keeping the alloy at a temperature of from the lower limit temperature (°C.) defined by the formula: 260 log C(%)+1300 to the upper limit temperature (°C.) defined by the formula: 16Mo(%)+10W(%)+10Cr(%)+777 for a period of time of 2 hours or less. These formulae have empirically been determined on the basis of data obtained by conducting a number of experiments. When the temperature is lower than said lower limit temperature, it is impossible to thoroughly dissolve the carbides, and a substantial amount of carbides remain undissolved making the alloy more susceptable to stress corrosion cracking. On the other hand, when the temperature is higher than the upper limit temperature or the residing period of time is longer than 2 hours, the crystal grains become coarser, and it is impossible to render a desirable level of strength by the succeeding cold working. Therefore, according to this invention, the solid solution treatment temperature and residing period of time therefor have been defined as in the above.

As already mentioned above, this invention employs cold working following the solid solution treatment in order to increase the level of strength of the alloy. However, when the reduction in thickness in the cold working is less than 10%, a desired level of strength cannot be obtained. On the other hand, when the reduction in thickness is more than 60%, a notable degree of deterioration in ductility and toughness is found. Therefore, according to this invention, the reduction in thickness during cold working is fixed within the range of from 10% to 60%.

Furthermore, in another aspect of this invention, hot working is carried out with a reduction in thickness of 10% or more for the temperature area of the recrystallizing point or below. When the reduction in thickness is less than 10%, it is not possible to provide a sufficient amount of recrystallized fine crystal grains, which will be essential to provide casing and tubing with a desired level of strength and ductility in the following heat treatment. Preferably, preheating at a temperature of 1050°-1250° C. is applied prior to the hot working. When the temperature is below 1050° C., the resistance of alloy to deforming is still high, and it is rather difficult to carry out working. In addition, a significant amount of intermetallic compounds and carbides remains undissolved, causing the toughness and corrosion resistance of the alloy to be decreased. On the other hand, when the temperature is higher than 1250° C., deforming in the hot working is so markedly decreased that it is rather difficult to apply hot working.

In a preferred embodiment, the alloy is hot worked with a reduction in thickness of 10% or more for the temperature range of from the recrystallizing point, usually approximately 1000° C. to the finishing temperature which is 800° C. or higher. When the finishing temperature is below 800° C., carbides tend to precipitate during hot working, resulting in deterioration in corrosion resistance.

The hot working may be followed by the heat treatment, i.e. solid solution treatment already detailed hereinbefore.

Thus, according to this invention, it is possible to manufacture deep well casing, tubing and drill pipes, etc., for example, which have a 0.2% offset yield strength of 80 kgf/mm$^2$, preferably 85 kgf/mm$^2$ or more as well as good ductility and toughness, and which have excellent resistance to stress corrosion cracking, by means of combining the specified alloy compositions and manufacturing conditions.

EXAMPLES

Molten alloys each having respective alloy compositions shown in the following Tables were prepared by using a combination of a conventional electric arc furnace, an Ar-Oxygen decarburizing furnace (AOD furnace) when it is necessary to carry out desulfurization and nitrogen addition, and an electro-slag remelting furnace (ESR furnace) when it is necessary to carry out dephosphorization. The thus prepared molten alloy was then cast into a round ingot having a diameter of 500 mm, to which hot forging was applied at a temperature of 1200° C. to provide a billet 150 mm in diameter.

During the hot forging the billet was visually examined for the formation of cracks for the purpose of evaluating the hot workability of the alloy. The billet was then subjected to hot extrusion to provide a pipe having a dimension of 60 mm diameter×4 mm wall thickness, and the thus obtained pipe was then subjected to cold working. Manufacturing conditions are also summarized in the following Tables.

Thus, pipes of this invention alloy, comparative ones in which some of their alloying elements are outside the range of this invention, and conventional ones were prepared. The conventional alloy Nos. 1–4 correspond to SUS 316 (JIS), SUS 310 S (JIS), Incoloy 800 and SUS 329 J1 (JIS), respectively.

Figure 5:
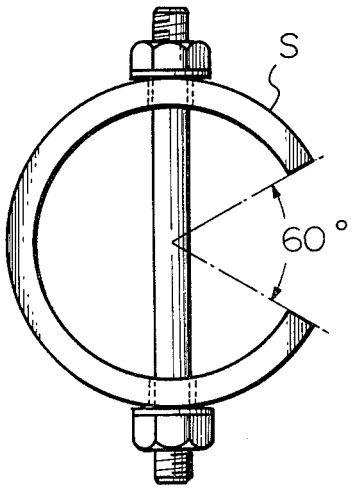
FIG. 5 is a schematic view of a testing sample put under tension by using a bolt and nut.

A ring-shaped specimen 20 mm long was cut from each of those pipes and then a portion of the circumferential length of the ring corresponding to the angle of 60° was cut off as shown in FIG. 5. The thus obtained test specimen was put under tension on the surface thereof at a tensile stress level corresponding to 0.2% off-set yield strength by means of a bolt and nut provided through the opposite wall portions of the ring. The specimen together with the bolt and nut was soaked in a 20% NaCl solution (bath temp. 150° C., 200° C., 300° C.) for 1000 hours. The solution was kept in equilibrium with the atmosphere wherein the $H_2S$ partial pressure was 0.1 atm., or 1 atm., or 15 atms. and the partial pressure of $CO_2$ is 10 atms. After finishing the stress corrosion cracking test in said NaCl solution, it was determined whether or not stress corrosion cracking had occurred. The test results are also summarized in the following Tables together with the test results of hot working cracking during the hot forging and experimental data of mechanical properties. In the following Tables in each column, the symbol "O" indicates the case where there was no cracking, and the symbol "X" shows the case where cracking occurred.

As is apparent from the experimental data, the comparative pipes do not meet the standards for any one of hot workability, tensile strength and stress corrosion cracking resistance. On the other hand, the pipes made by this invention are satisfactory with respect to all these properties. Namely, the pipes made by this invention have a desired level of mechanical strength and resistance to stress corrosion cracking as well as satisfactory hot workability, and with respect to these properties are also superior to those of the conventional pipes made of conventional alloys.

TABLE 1

| Alloy No. | Alloy Composition (Weight %) C | Si | Mn | P | S | sol. Al | Ni | Cr | Mo | W | Others | Solid solution treatment Temp. (°C.) | Time (hr) | Reduction in thickness (%) |
|---|---|---|---|---|---|---|---|---|---|---|---|---|---|---|
| This Invention | | | | | | | | | | | | | | |
| 1 | 0.02 | 0.24 | 0.59 | 0.017 | 0.001 | 0.14 | 50.6 | 25.3 | 3.7 | — | (N: 0.026) — | 900 | 1.0 | 12 |
| 2 | | | | | | | | | | | | 1050 | | 35 |
| 3 | | | | | | | | | | | | | | 59 |
| 4 | 0.02 | 0.16 | 0.75 | 0.014 | 0.002 | 0.19 | 35.9 | 24.9 | 2.9 | — | (N: 0.021) — | 1000 | | 22 |
| 5 | 0.01 | 0.25 | 0.88 | 0.016 | 0.002 | 0.23 | 59.3 | 25.0 | 3.1 | — | (N: 0.028) — | 1050 | 0.5 | |
| 6 | 0.01 | 0.18 | 0.91 | 0.013 | 0.001 | 0.21 | 40.2 | 23.2 | 3.3 | — | (N: 0.023) — | 1020 | | |
| 7 | 0.008 | 0.10 | 0.86 | 0.030 | 0.003 | 0.19 | 39.8 | 34.5 | 2.7 | — | (N: 0.018) — | 1100 | | |
| 8 | 0.03 | 0.31 | 0.97 | 0.019 | 0.001 | 0.21 | 36.7 | 34.7 | 1.6 | — | (N: 0.026) — | 950 | 1.0 | |
| 9 | 0.02 | 0.52 | 0.69 | 0.008 | 0.001 | 0.17 | 45.2 | 30.5 | 3.9 | — | (N: 0.023) — | 1050 | | |
| 10 | 0.01 | 0.38 | 0.82 | 0.019 | 0.002 | 0.39 | 50.6 | 23.8 | 1.5 | 2.8 | (N: 0.020) — | 980 | | |
| 11 | 0.02 | 0.11 | 0.71 | 0.015 | 0.0005 | 0.09 | 51.3 | 34.8 | — | 3.1 | (N: 0.024) — | 950 | | |
| 12 | 0.01 | 0.07 | 0.69 | 0.015 | 0.002 | 0.24 | 56.5 | 25.5 | — | 7.7 | (N: 0.023) — | 1050 | | |
| 13 | 0.02 | 0.23 | 0.77 | 0.014 | 0.001 | 0.20 | 57.2 | 29.6 | 2.4 | — | Cu: 1.9 (N: 0.024) | | | |
| 14 | 0.02 | 0.22 | 0.81 | 0.017 | 0.001 | 0.18 | 51.3 | 28.2 | 2.6 | 1.2 | Cu: 0.5, Co: 1.7 (N: 0.021) | | | |
| 15 | 0.01 | 0.35 | 1.76 | 0.003 | 0.002 | 0.43 | 49.8 | 28.7 | 3.0 | 0.4 | La+Ce: 0.023 (N: 0.022) | | | |
| 16 | 0.01 | 0.15 | 0.92 | 0.011 | 0.001 | 0.36 | 47.2 | 30.1 | 2.5 | — | Y: 0.043 (N: 0.019) | | | |
| 17 | 0.02 | 0.22 | 0.72 | 0.024 | 0.0003 | 0.18 | 49.6 | 31.2 | 2.1 | — | Mg: 0.016 (N: 0.022) | | | |
| 18 | 0.02 | 0.34 | 0.98 | 0.012 | 0.001 | 0.27 | 41.3 | 30.4 | 2.6 | — | Ca: 0.025, Co: 1.6 (N: 0.016) | | | |
| 19 | 0.01 | 0.17 | 0.93 | 0.027 | 0.002 | 0.10 | 49.6 | 29.6 | 2.9 | — | Ti: 0.39 (N: 0.019) | | | |
| 20 | 0.01 | 0.14 | 0.86 | 0.021 | 0.001 | 0.16 | 47.2 | 28.7 | 3.3 | — | Y: 0.028, Mg: 0.019 (N: 0.018) | | | |
| 21 | 0.02 | 0.17 | 0.98 | 0.003 | 0.003 | 0.27 | 49.2 | 25.3 | 3.8 | — | La+Ce: 0.016, Ca: 0.027, Ti: 0.08 (N: 0.017) | 1000 | | |
| 22 | 0.01 | 0.09 | 0.72 | 0.016 | 0.001 | 0.09 | 48.6 | 24.6 | 2.7 | — | Cu: 1.6, Ca: 0.036 (N: 0.025) | | | |
| 23 | 0.01 | 0.11 | 0.76 | 0.025 | 0.001 | 0.14 | 40.3 | 23.6 | 3.0 | — | Cu: 1.7, Co: 1.4, Y: 0.046, Mg: 0.009 (N: 0.24) | | | |

TABLE 1-continued

| Alloy No. | Alloy Composition (Weight %) C | Si | Mn | P | S | sol. Al | Ni | Cr | Mo | W | Others | Solid solution treatment Temp. (°C.) | Time (hr) | Reduction in thickness (%) |
|---|---|---|---|---|---|---|---|---|---|---|---|---|---|---|
| 24 | 0.008 | 0.35 | 0.69 | 0.021 | 0.002 | 0.12 | 41.2 | 27.2 | 2.3 | — | N: 0.25 | | | |
| 25 | 0.02 | 0.27 | 0.91 | 0.019 | 0.001 | 0.15 | 46.7 | 29.6 | 2.6 | — | N: 0.16, Cu: 1.3 | 1050 | | |
| 26 | 0.01 | 0.15 | 1.33 | 0.016 | 0.0009 | 0.35 | 55.6 | 31.3 | 3.3 | 1.0 | N: 0.18, Y: 0.038 | | | |
| 27 | 0.01 | 0.19 | 0.86 | 0.018 | 0.002 | 0.19 | 57.2 | 27.7 | 2.7 | — | N: 0.12, Mg: 0.016 | | | |
| 28 | 0.01 | 0.13 | 0.92 | 0.026 | 0.0008 | 0.21 | 53.3 | 29.6 | 2.8 | — | N: 0.10, La+Ce: 0.027, Ti: 0.13 | | | |
| 29 | 0.02 | 0.22 | 0.84 | 0.027 | 0.001 | 0.23 | 56.2 | 25.6 | 3.5 | — | N: 0.09, Cu: 1.3, Co: 0.9, Y: 0.031, Mg: 0.010 | | | |
| Comparative | | | | | | | | | | | | | | |
| 1 | 0.02 | 0.26 | 0.75 | 0.018 | 0.002 | 0.26 | 33.8* | 27.3 | 3.1 | — | — (N: 0.017) | | | |
| 2 | 0.01 | 0.35 | 0.88 | 0.026 | 0.009* | 0.20 | 46.3 | 37.0* | 2.6 | 0.4 | — (N: 0.016) | | | |
| 3 | 0.03 | 0.17 | 0.49 | 0.019 | 0.003 | 0.17 | 38.2 | 29.2 | 1.4* | — | — (N: 0.022) | | | |
| 4 | 0.02 | 0.13 | 0.83 | 0.018 | 0.001 | 0.16 | 45.3 | 23.5 | — | 2.8* | — (N: 0.019) | 1000 | | |
| 5 | 0.02 | 0.21 | 0.79 | 0.017 | 0.002 | 0.14 | 41.6 | 25.2 | 2.0 | — | — (N: 0.025) | 750* | | |
| 6 | | | | | | | | | | | | 1100* | | |
| 7 | | | | | | | | | | | | 1000 | | 5* |
| 8 | | | | | | | | | | | | | | 65* |
| Conventional | | | | | | | | | | | | | | |
| 1 | 0.04 | 0.52 | 1.41 | 0.027 | 0.011 | 0.01 | 12.8 | 17.2 | 2.4 | — | Cu: 0.1 (N: 0.020) | 1050 | | 22 |
| 2 | 0.05 | 0.50 | 1.29 | 0.028 | 0.012 | — | 20.4 | 25.2 | — | — | — (N: 0.014) | | | |
| 3 | 0.05 | 0.52 | 1.10 | 0.016 | 0.008 | 0.32 | 31.8 | 20.5 | — | — | T: 0.26 (N: 0.035) | | | |
| 4 | 0.04 | 0.49 | 0.82 | 0.025 | 0.010 | — | 5.4 | 25.4 | 2.2 | — | — (N: 0.027) | | | |

NOTE:
*outside the range of this invention
Nitrogen amounts within the parentheses are those as an impurity.

TABLE 2

| Alloy No. | Cracking during hot forging | Cracking in $H_2S$—10 atm $CO_2$ in 20% NaCl at 150° C. $H_2S$ 0.1 atm | $H_2S$ 1 atm | $H_2S$ 15 atms | 0.2% Offset yield strength (kgf/mm$^2$) | Tensile strength (kgf/mm$^2$) | Elongation (%) | Reduction of area (%) | Impact value (kg · m/cm$^2$ at 0° C.) |
|---|---|---|---|---|---|---|---|---|---|
| This Invention | | | | | | | | | |
| 1 | O | O | O | O | 80.8 | 84.2 | 12 | 53 | 5.6 |
| 2 | | | | | 98.5 | 101.3 | 13 | 66 | 13.4 |
| 3 | | | | | 124.3 | 129.1 | 11 | 61 | 8.6 |
| 4 | | | | | 83.6 | 86.7 | 16 | 77 | 18.9 |
| 5 | | | | | 85.2 | 89.1 | 18 | 79 | 21.3 |
| 6 | | | | | 84.1 | 86.3 | 16 | 78 | 20.4 |
| 7 | | | | | 86.5 | 90.5 | 15 | 73 | 18.6 |
| 8 | | | | | 93.3 | 97.4 | 13 | 68 | 14.2 |
| 9 | | | | | 87.7 | 91.2 | 17 | 79 | 22.9 |
| 10 | | | | | 89.1 | 94.3 | 15 | 72 | 18.0 |
| 11 | | | | | 95.1 | 99.4 | 15 | 70 | 13.6 |
| 12 | | | | | 82.9 | 87.9 | 17 | 75 | 16.8 |
| 13 | | | | | 83.6 | 89.3 | 21 | 80 | 24.1 |
| 14 | | | | | 89.9 | 94.2 | 14 | 70 | 19.5 |
| 15 | | | | | 88.3 | 93.6 | 15 | 72 | 20.8 |
| 16 | | | | | 86.6 | 90.3 | 17 | 78 | 21.4 |
| 17 | | | | | 85.3 | 88.6 | 16 | 73 | 16.0 |
| 18 | | | | | 89.5 | 91.9 | 13 | 76 | 17.7 |
| 19 | | | | | 86.3 | 89.7 | 16 | 75 | 17.6 |
| 20 | | | | | 83.6 | 86.9 | 16 | 79 | 24.3 |
| 21 | | | | | 85.3 | 88.7 | 16 | 79 | 22.3 |
| 22 | | | | | 83.6 | 87.2 | 15 | 75 | 18.4 |
| 23 | | | | | 100.1 | 100.4 | 18 | 79 | 25.0 |
| 24 | | | | | 106.2 | 109.7 | 12 | 57 | 16.9 |
| 25 | | | | | 103.7 | 107.1 | 11 | 60 | 16.4 |
| 26 | | | | | 100.2 | 105.8 | 14 | 76 | 15.3 |
| 27 | | | | | 92.7 | 97.8 | 16 | 75 | 17.4 |
| 28 | | | | | 95.2 | 98.4 | 14 | 68 | 12.7 |
| 29 | | | | | 83.6 | 87.7 | 18 | 81 | 24.0 |
| Comparative | | | | | | | | | |
| 1 | | | | X | 81.5 | 85.4 | 13 | 68 | 8.2 |
| 2 | X | — | — | — | — | — | — | — | — |
| 3 | O | O | O | X | 78.2 | 82.6 | 13 | 72 | 12.8 |
| 4 | | | | | 76.7 | 79.6 | 13 | 75 | 16.4 |
| 5 | | | X | | 97.3 | 101.6 | 9 | 32 | 4.1 |
| 6 | | | O | | 76.3 | 79.7 | 18 | 81 | 24.6 |
| 7 | | | | | 48.4 | 76.2 | 27 | 80 | 26.7 |
| 8 | | | | | 131.5 | 135.4 | 6 | 28 | 3.7 |
| Conventional | | | | | | | | | |
| 1 | | X | X | | 71.1 | 72.8 | 16 | 80 | 23.1 |
| 2 | | | | | 71.8 | 74.8 | 18 | 81 | 17.3 |

TABLE 2-continued

| Alloy No. | Cracking during hot forging | Cracking in $H_2S$—10 atm $CO_2$ in 20% NaCl at 150° C. $H_2S$ 0.1 atm | $H_2S$ 1 atm | $H_2S$ 15 atms | 0.2% Offset yield strength (kgf/mm$^2$) | Tensile strength (kgf/mm$^2$) | Elongation (%) | Reduction of area (%) | Impact value (kg · m/cm$^2$ at 0° C.) |
|---|---|---|---|---|---|---|---|---|---|
| 3 | | | | | 73.5 | 75.0 | 16 | 82 | 22.5 |
| 4 | | | | | 90.2 | 91.7 | 14 | 73 | 17.7 |

NOTE:
Alloy Nos. correspond to those of Table 1.

TABLE 3

| Alloy No. | Alloy Composition (Weight %) C | Si | Mn | P | S | sol. Al | Ni | Cr | Mo | W | Others | Solid Solution treatment Temp. (°C.) | Time (hr) | Reduction in thickness (%) |
|---|---|---|---|---|---|---|---|---|---|---|---|---|---|---|
| 1 | 0.01 | 0.17 | 0.76 | 0.012 | 0.002 | 0.17 | 51.3 | 24.6 | 5.9 | — | (N: 0.021) — | 900 | 1.0 | 12 |
| 2 | | | | | | | | | | | | 1050 | | 35 |
| 3 | | | | | | | | | | | | | | 60 |
| 4 | 0.02 | 0.19 | 0.81 | 0.015 | 0.001 | 0.20 | 25.8 | 25.8 | 5.3 | — | (N: 0.018) — | 1000 | 0.5 | 22 |
| 5 | 0.008 | 0.17 | 0.64 | 0.014 | 0.002 | 0.14 | 59.1 | 25.4 | 5.6 | — | (N: 0.026) — | 920 | 0.5 | |
| 6 | 0.01 | 0.26 | 0.73 | 0.008 | 0.0002 | 0.22 | 30.4 | 23.0 | 5.7 | — | (N: 0.018) — | 1000 | 0.5 | |
| 7 | 0.01 | 0.08 | 0.46 | 0.017 | 0.001 | 0.43 | 29.6 | 29.1 | 6.1 | — | (N: 0.028) — | 950 | 1.0 | |
| 8 | 0.01 | 0.19 | 0.86 | 0.012 | 0.002 | 0.26 | 31.5 | 29.3 | 4.2 | — | (N: 0.022) — | 1100 | 0.3 | |
| 9 | 0.02 | 0.22 | 0.71 | 0.011 | 0.001 | 0.18 | 32.6 | 25.5 | 7.9 | — | (N: 0.021) — | 1050 | | |
| 10 | 0.02 | 0.14 | 0.94 | 0.017 | 0.001 | 0.16 | 40.5 | 22.9 | 3.1 | 6.4 | (N: 0.014) — | | | |
| 11 | 0.01 | 0.16 | 0.83 | 0.003 | 0.0004 | 0.12 | 41.3 | 28.8 | — | 8.3 | (N: 0.022) — | | | |
| 12 | 0.01 | 0.06 | 0.90 | 0.021 | 0.002 | 0.36 | 50.6 | 25.2 | — | 15.4 | (N: 0.023) — | | | |
| 13 | 0.02 | 0.11 | 0.94 | 0.013 | 0.002 | 0.20 | 50.8 | 29.2 | 5.6 | — | Cu: 1.9 (N: 0.022) | | | |
| 14 | 0.005 | 0.19 | 0.81 | 0.016 | 0.001 | 0.14 | 30.5 | 28.1 | 5.2 | 2.6 | Co: 1.8 (N: 0.017) | | | |
| 15 | 0.02 | 0.14 | 1.59 | 0.014 | 0.001 | 0.19 | 41.2 | 25.6 | 6.2 | — | Y: 0.038 (N: 0.016) | 1000 | | |
| 16 | 0.008 | 0.22 | 0.98 | 0.021 | 0.001 | 0.16 | 56.8 | 29.0 | 5.9 | — | Ti: 0.34 (N: 0.018) | | | |
| 17 | 0.01 | 0.23 | 0.82 | 0.024 | 0.001 | 0.20 | 59.3 | 28.3 | 6.6 | — | Y: 0.025, Mg: 0.011 (N: 0.021) | | | |
| 18 | 0.02 | 0.11 | 0.69 | 0.014 | 0.001 | 0.14 | 47.1 | 24.6 | 6.7 | — | La+Ce: 0.016, Ca: 0.031, Ti: 0.10 (N: 0.014) | 1050 | 1.0 | |
| 19 | 0.01 | 0.22 | 0.96 | 0.013 | 0.002 | 0.20 | 49.3 | 25.2 | 5.9 | — | Cu: 1.7, Ca: 0.031 (N: 0.023) | | | |
| 20 | 0.009 | 0.17 | 0.93 | 0.021 | 0.002 | 0.38 | 41.2 | 25.3 | 6.2 | — | Cu: 1.2, Co: 0.9, Y: 0.038 Mg: 0.007 (N: 0.019) | | | |
| 21 | 0.02 | 0.34 | 1.61 | 0.019 | 0.002 | 0.18 | 38.6 | 27.8 | 5.9 | — | N: 0.26 | | | |
| 22 | 0.01 | 0.26 | 0.72 | 0.022 | 0.001 | 0.22 | 39.2 | 29.1 | 6.3 | — | N: 0.14, Cu: 1.6 | | | |
| 23 | 0.01 | 0.42 | 0.84 | 0.018 | 0.001 | 0.26 | 51.3 | 26.5 | 6.2 | 1.3 | N: 0.19, Y: 0.037 | | | |
| 24 | 0.02 | 0.18 | 0.83 | 0.022 | 0.002 | 0.27 | 56.2 | 23.2 | 7.3 | — | N: 0.10, Mg: 0.014 | | | |
| 25 | 0.02 | 0.22 | 0.81 | 0.020 | 0.0007 | 0.13 | 55.6 | 28.2 | 6.6 | — | N: 0.08, La+Ce: 0.022, Ti: 0.08 | | | |
| 26 | 0.01 | 0.08 | 0.86 | 0.017 | 0.001 | 0.21 | 59.2 | 27.6 | 5.4 | — | N: 0.13, Cu: 0.9, Co: 1.3, Y: 0.020, Mg: 0.011 | | | |
| Comparative | | | | | | | | | | | | | | |
| 1 | 0.03 | 0.13 | 0.67 | 0.016 | 0.001 | 0.15 | 23.8* | 25.6 | 5.8 | 1.2 | — (N: 0.024) | | | |
| 2 | 0.01 | 0.24 | 0.91 | 0.024 | 0.011* | 0.26 | 46.3 | 31.5* | 6.1 | — | — (N: 0.022) | | | |
| 3 | 0.02 | 0.15 | 0.78 | 0.012 | 0.003 | 0.14 | 40.2 | 27.2 | 3.7* | — | — (N: 0.027) | | | |
| 4 | 0.01 | 0.22 | 0.81 | 0.018 | 0.002 | 0.27 | 35.6 | 26.3 | — | 7.4* | — (N: 0.018) | | | |
| 5 | 0.01 | 0.21 | 0.88 | 0.016 | 0.002 | 0.21 | 41.4 | 25.6 | 4.3 | — | — (N: 0.020) | 760* | | |
| 6 | | | | | | | | | | | | 1200* | | |
| 7 | | | | | | | | | | | | 1050 | | 5* |
| 8 | | | | | | | | | | | | | | 65* |

NOTE:
*outside the range of this invention.
Nitrogen amounts within the parentheses are those as an impurity.

TABLE 4

| Alloy No. | Cracking during hot forging | Cracking in $H_2S$—10 atm $CO_2$ in 20% NaCl at 200° C. $H_2S$ 0.1 atm | $H_2S$ 1 atm | $H_2S$ 15 atms | 0.2% Offset yield strength (kgf/mm$^2$) | Tensile strength (kgf/mm$^2$) | Elongation (%) | Reduction of area (%) | Impact value (kg · m/cm$^2$ at 0° C.) |
|---|---|---|---|---|---|---|---|---|---|
| This Invention | | | | | | | | | |
| 1 | O | O | O | O | 80.7 | 85.2 | 19 | 80 | 22.5 |
| 2 | | | | | 101.8 | 106.2 | 14 | 75 | 15.4 |
| 3 | | | | | 118.9 | 122.9 | 12 | 68 | 17.7 |
| 4 | | | | | 93.8 | 99.4 | 10 | 39 | 17.5 |
| 5 | | | | | 98.0 | 103.7 | 14 | 72 | 13.7 |
| 6 | | | | | 85.5 | 88.7 | 12 | 61 | 18.4 |
| 7 | | | | | 96.2 | 101.5 | 10 | 44 | 15.6 |
| 8 | | | | | 91.4 | 96.3 | 12 | 51 | 10.6 |
| 9 | | | | | 89.4 | 92.3 | 15 | 78 | 19.3 |
| 10 | | | | | 85.1 | 88.6 | 15 | 79 | 20.6 |

TABLE 4-continued

| Alloy No. | Cracking during hot forging | Cracking in $H_2S$—10 atm $CO_2$ in 20% NaCl at 200° C. $H_2S$ 0.1 atm | $H_2S$ 1 atm | $H_2S$ 15 atms | 0.2% Offset yield strength (kgf/mm$^2$) | Tensile strength (kgf/mm$^2$) | Elongation (%) | Reduction of area (%) | Impact value (kg · m/cm$^2$ at 0° C.) |
|---|---|---|---|---|---|---|---|---|---|
| 11 | | | | | 95.4 | 102.5 | 10 | 43 | 15.2 |
| 12 | | | | | 93.6 | 98.7 | 14 | 66 | 11.5 |
| 13 | | | | | 86.4 | 92.5 | 19 | 76 | 19.1 |
| 14 | | | | | 96.7 | 102.0 | 10 | 38 | 15.4 |
| 15 | | | | | 88.6 | 92.6 | 15 | 79 | 10.6 |
| 16 | | | | | 86.1 | 93.1 | 19 | 75 | 14.2 |
| 17 | | | | | 89.5 | 95.7 | 20 | 77 | 20.4 |
| 18 | | | | | 94.6 | 99.2 | 14 | 68 | 13.4 |
| 19 | | | | | 91.3 | 95.5 | 17 | 77 | 19.6 |
| 20 | | | | | 89.4 | 92.3 | 15 | 78 | 16.3 |
| 21 | | | | | 118.4 | 125.3 | 8 | 37 | 15.4 |
| 22 | | | | | 108.3 | 114.2 | 10 | 42 | 17.6 |
| 23 | | | | | 101.4 | 107.5 | 17 | 71 | 16.1 |
| 24 | | | | | 98.6 | 103.2 | 12 | 75 | 16.9 |
| 25 | | | | | 96.1 | 101.9 | 15 | 72 | 14.4 |
| 26 | | | | | 98.2 | 103.4 | 15 | 74 | 15.4 |
| Comparative | | | | | | | | | |
| 1 | | | | X | 93.6 | 97.2 | 5 | 21 | 0.5 |
| 2 | X | — | — | — | — | — | — | — | — |
| 3 | O | O | O | X | 89.5 | 91.8 | 13 | 76 | 17.3 |
| 4 | | | | | 81.5 | 85.4 | 13 | 67 | 8.2 |
| 5 | | | X | | 94.8 | 97.7 | 13 | 65 | 4.6 |
| 6 | | | O | | 76.4 | 79.5 | 18 | 81 | 24.6 |
| 7 | | | | | 43.4 | 76.5 | 29 | 82 | 25.4 |
| 8 | | | | | 136.5 | 141.2 | 7 | 28 | 4.0 |

NOTE:
Alloy Nos. correspond to those of Table 3.

TABLE 5

| Alloy No. | Alloy Composition (Weight %) C | Si | Mn | P | S | sol. Al | Ni | Cr | Mo | W | Others | Solid Solution treatment Temp. (°C.) | Time (hr) | Reduction in thickness (%) |
|---|---|---|---|---|---|---|---|---|---|---|---|---|---|---|
| This Invention | | | | | | | | | | | | | | |
| 1 | 0.01 | 0.23 | 0.68 | 0.016 | 0.001 | 0.13 | 48.2 | 20.7 | 9.8 | — | (N: 0.027) — | 900 | 1.0 | 13 |
| 2 | | | | | | | | | | | | 1100 | | 35 |
| 3 | | | | | | | | | | | | | | 60 |
| 4 | 0.03 | 0.33 | 0.92 | 0.022 | 0.002 | 0.16 | 31.2 | 20.4 | 9.6 | — | (N: 0.016) — | 1050 | 0.5 | 22 |
| 5 | 0.02 | 0.21 | 0.76 | 0.007 | 0.001 | 0.22 | 59.5 | 19.8 | 10.2 | — | (N: 0.034) — | | 1.0 | |
| 6 | 0.01 | 0.12 | 0.92 | 0.016 | 0.0008 | 0.12 | 40.7 | 15.8 | 10.1 | — | (N: 0.019) — | 950 | 2.0 | |
| 7 | 0.01 | 0.09 | 0.76 | 0.003 | 0.001 | 0.14 | 41.2 | 29.4 | 10.6 | — | (N: 0.018) — | 1200 | 0.2 | |
| 8 | 0.02 | 0.07 | 0.68 | 0.021 | 0.0006 | 0.18 | 33.5 | 29.6 | 8.2 | — | (N: 0.024) — | 1100 | 1.0 | |
| 9 | 0.008 | 0.19 | 0.82 | 0.015 | 0.001 | 0.46 | 48.2 | 19.9 | 11.5 | — | (N: 0.017) — | 1000 | | |
| 10 | 0.01 | 0.26 | 0.91 | 0.020 | 0.002 | 0.28 | 40.6 | 27.8 | 4.2 | 8.1 | (N: 0.019) — | 1100 | | |
| 11 | 0.01 | 0.33 | 0.86 | 0.008 | 0.0005 | 0.12 | 46.2 | 28.7 | — | 16.7 | (N: 0.023) — | | | |
| 12 | 0.02 | 0.08 | 0.70 | 0.022 | 0.001 | 0.14 | 50.5 | 16.4 | — | 23.1 | (N: 0.020) — | | | |
| 13 | 0.02 | 0.20 | 0.82 | 0.016 | 0.001 | 0.18 | 51.3 | 17.2 | 9.3 | — | Cu: 1.8 (N: 0.019) | 1000 | | |
| 14 | 0.006 | 0.34 | 1.68 | 0.015 | 0.002 | 0.33 | 56.6 | 20.5 | 11.2 | 2.7 | Co: 0.7 (N: 0.028) | 1100 | | |
| 15 | 0.01 | 0.23 | 0.86 | 0.012 | 0.001 | 0.13 | 34.2 | 19.8 | 10.6 | 1.2 | La+Ce: 0.026 (N: 0.014) | | | |
| 16 | 0.01 | 0.14 | 0.88 | 0.029 | 0.001 | 0.12 | 35.6 | 25.6 | 9.3 | — | Y: 0.042 (N: 0.019) | | | |
| 17 | 0.02 | 0.14 | 0.98 | 0.020 | 0.001 | 0.28 | 56.3 | 29.0 | 10.7 | — | Ti: 0.43 (N: 0.017) | | | |
| 18 | 0.01 | 0.28 | 0.92 | 0.022 | 0.001 | 0.16 | 50.5 | 28.6 | 11.6 | — | Y: 0.019, Mg: 0.021 (N: 0.016) | | | |
| 19 | 0.01 | 0.17 | 0.73 | 0.012 | 0.002 | 0.15 | 37.6 | 20.6 | 10.3 | — | La+Ce: 0.024, Ca: 0.022 Ti: 0.13 (N: 0.019) | | | |
| 20 | 0.01 | 0.34 | 0.79 | 0.010 | 0.001 | 0.36 | 39.1 | 21.3 | 9.9 | — | Cu: 1.4, Ca: 0.031 (N: 0.024) | | | |
| 21 | 0.02 | 0.21 | 1.14 | 0.013 | 0.001 | 0.13 | 45.6 | 16.8 | 10.4 | — | Cu: 0.7, Co: 1.6, Y: 0.039, Mg: 0.008 (N: 0.017) | | | |
| 22 | 0.02 | 0.23 | 0.87 | 0.018 | 0.002 | 0.14 | 48.2 | 17.6 | 9.6 | — | N: 0.27 | | | |
| 23 | 0.007 | 0.13 | 0.73 | 0.022 | 0.0005 | 0.25 | 50.6 | 25.2 | 10.3 | — | N: 0.15, Cu: 1.4 | | | |
| 24 | 0.01 | 0.09 | 1.29 | 0.023 | 0.001 | 0.17 | 48.6 | 24.6 | 9.2 | — | N: 0.21, Y: 0.041 | | | |
| 25 | 0.02 | 0.26 | 0.67 | 0.019 | 0.001 | 0.18 | 55.6 | 23.5 | 11.1 | — | N: 0.13, Mg: 0.015 | | | |
| 26 | 0.01 | 0.24 | 0.79 | 0.017 | 0.002 | 0.27 | 58.2 | 22.5 | 9.2 | 0.8 | N: 0.07, La+Ce: 0.017, Ti: 0.03 | | | |
| 27 | 0.01 | 0.13 | 0.78 | 0.025 | 0.002 | 0.21 | 57.6 | 20.9 | 8.6 | 2.3 | N: 0.11, Cu: 1.3, Co: 0.7, Y: 0.025, Mg: 0.009 | | | |
| Comparative | | | | | | | | | | | | | | |
| 1 | 0.02 | 0.17 | 0.75 | 0.024 | 0.003 | 0.26 | 28.8* | 27.3 | 9.2 | — | — (N: 0.021) | | | |
| 2 | 0.02 | 0.27 | 0.86 | 0.018 | 0.010* | 0.21 | 49.3 | 31.5* | 8.6 | — | — (N: 0.026) | | | |
| 3 | 0.02 | 0.20 | 0.84 | 0.011 | 0.001 | 0.38 | 35.2 | 20.6 | 7.4* | — | — (N: 0.017) | 1000 | | |
| 4 | 0.01 | 0.14 | 0.71 | 0.016 | 0.002 | 0.13 | 31.6 | 25.2 | — | 14.8* | — (N: 0.019) | 1100 | | |
| 5 | 0.02 | 0.17 | 0.76 | 0.012 | 0.002 | 0.21 | 41.6 | 20.6 | 7.5 | — | — (N: 0.018) | 840* | | |
| 6 | | | | | | | | | | | | 1200* | | |

TABLE 5-continued

| Alloy No. | Alloy Composition (Weight %) C | Si | Mn | P | S | sol. Al | Ni | Cr | Mo | W | Others | Solid Solution treatment Temp. (°C.) | Time (hr) | Reduction in thickness (%) |
|---|---|---|---|---|---|---|---|---|---|---|---|---|---|---|
| 7 | | | | | | | | | | | | 1050 | | 5* |
| 8 | | | | | | | | | | | | | | 65* |

NOTE:
*Outside the range of this invention
Nitrogen amounts within the parentheses are those as an impurity.

TABLE 6

| Alloy No. | Cracking during hot forging | Cracking in $H_2S$—10 atm $CO_2$ in 20% NaCl at 300° C. $H_2S$ 0.1 atm | $H_2S$ 1 atm | $H_2S$ 15 atms | 0.2% Offset yield strength (kgf/mm$^2$) | Tensile strength (kgf/mm$^2$) | Elongation (%) | Reduction of area (%) | Impact value (kg · m/cm$^2$ at 0° C.) |
|---|---|---|---|---|---|---|---|---|---|
| This Invention | | | | | | | | | |
| 1 | O | O | O | O | 86.0 | 91.2 | 16 | 61 | 12.4 |
| 2 | | | | | 99.5 | 104.5 | 16 | 73 | 9.7 |
| 3 | | | | | 123.1 | 128.9 | 11 | 67 | 9.0 |
| 4 | | | | | 88.6 | 94.9 | 11 | 49 | 5.1 |
| 5 | | | | | 89.4 | 97.1 | 19 | 78 | 20.2 |
| 6 | | | | | 89.4 | 96.0 | 16 | 74 | 14.1 |
| 7 | | | | | 87.9 | 94.6 | 18 | 72 | 16.9 |
| 8 | | | | | 86.8 | 93.3 | 18 | 69 | 13.6 |
| 9 | | | | | 89.2 | 94.0 | 16 | 72 | 11.6 |
| 10 | | | | | 88.4 | 95.3 | 18 | 70 | 17.4 |
| 11 | | | | | 86.9 | 93.6 | 17 | 67 | 12.5 |
| 12 | | | | | 87.8 | 92.1 | 18 | 79 | 23.6 |
| 13 | | | | | 92.8 | 96.6 | 18 | 78 | 22.8 |
| 14 | | | | | 86.7 | 94.6 | 19 | 73 | 16.2 |
| 15 | | | | | 90.8 | 96.6 | 13 | 62 | 7.7 |
| 16 | | | | | 86.4 | 93.3 | 17 | 70 | 10.9 |
| 17 | | | | | 93.4 | 99.2 | 19 | 75 | 20.3 |
| 18 | | | | | 90.8 | 97.6 | 19 | 68 | 13.3 |
| 19 | | | | | 91.8 | 95.6 | 15 | 63 | 9.5 |
| 20 | | | | | 89.8 | 95.3 | 15 | 61 | 7.6 |
| 21 | | | | | 87.8 | 91.6 | 18 | 78 | 23.6 |
| 22 | | | | | 108.4 | 112.7 | 13 | 71 | 19.8 |
| 23 | | | | | 101.9 | 108.7 | 18 | 69 | 16.2 |
| 24 | | | | | 105.8 | 112.3 | 18 | 68 | 15.7 |
| 25 | | | | | 103.6 | 110.4 | 17 | 69 | 13.9 |
| 26 | | | | | 97.8 | 105.4 | 18 | 71 | 21.4 |
| 27 | | | | | 101.9 | 109.4 | 19 | 70 | 18.8 |
| Comparative | | | | | | | | | |
| 1 | | | | X | 82.3 | 86.9 | 9 | 39 | 0.7 |
| 2 | X | — | — | — | — | — | — | — | — |
| 3 | O | O | O | X | 86.2 | 90.0 | 10 | 58 | 6.7 |
| 4 | | | | | 95.3 | 97.6 | 5 | 26 | 0.7 |
| 5 | | | X | | 97.3 | 100.4 | 12 | 68 | 3.1 |
| 6 | | | O | | 81.8 | 85.9 | 15 | 80 | 22.3 |
| 7 | | | | | 44.1 | 75.6 | 28 | 80 | 26.5 |
| 8 | | | | | 125.6 | 130.9 | 6 | 31 | 3.1 |

NOTE:
Alloy Nos. correspond those of Table 5.

TABLE 7

| Alloy No. | Alloy Composition (Weight %) C | Si | Mn | P | S | sol. Al | Ni | Cr | Mo | W | Others | Hot Working Heating temp. (°C.) | **Reduction in thickness (%) | Solid solution treatment Temp. (°C.) | Time (hr) | Reduction in thickness during cold working (%) |
|---|---|---|---|---|---|---|---|---|---|---|---|---|---|---|---|---|
| This Invention | | | | | | | | | | | | | | | | |
| 1 | 0.01 | 0.12 | 0.78 | 0.010 | 0.002 | 0.13 | 48.6 | 25.2 | 3.2 | 0.2 | — (N: 0.023) | 1200 | 10 | 1050 | 1.0 | 22 |
| 2 | | | | | | | | | | | | | 20 | | | |
| 3 | | | | | | | | | | | | | 30 | | | |
| 4 | | | | | | | | | | | | | 50 | | | |
| 5 | | | | | | | | | | | | | 30 | 950 | | 10 |
| 6 | | | | | | | | | | | | | | | | 35 |
| 7 | | | | | | | | | | | | | | | | 60 |
| 8 | 0.03 | 0.38 | 1.58 | 0.021 | 0.001 | 0.23 | 35.6 | 29.6 | 2.6 | 0.3 | — (N: 0.016) | | | 1050 | | 22 |
| 9 | 0.01 | 0.34 | 1.09 | 0.015 | 0.002 | 0.16 | 59.0 | 27.2 | 2.2 | 1.6 | — (N: 0.031) | | | | | |

TABLE 7-continued

| Alloy No. | Alloy Composition (Weight %) C | Si | Mn | P | S | sol. Al | Ni | Cr | Mo | W | Others | Hot Working: Heating temp. (°C.) | Hot Working: **Reduction in thickness (%) | Solid solution treatment: Temp. (°C.) | Solid solution treatment: Time (hr) | Reduction in thickness during cold working (%) |
|---|---|---|---|---|---|---|---|---|---|---|---|---|---|---|---|---|
| 10 | 0.02 | 0.24 | 0.88 | 0.003 | 0.0005 | 0.11 | 38.6 | 34.4 | 2.8 | 0.4 | — (N: 0.013) | | | | | |
| 11 | 0.01 | 0.26 | 0.74 | 0.009 | 0.001 | 0.24 | 39.2 | 34.6 | 1.6 | — | — (N: 0.024) | | | | | |
| 12 | 0.02 | 0.18 | 0.58 | 0.016 | 0.002 | 0.22 | 47.2 | 34.7 | — | 3.2 | — (N: 0.023) | | | | | |
| 13 | 0.01 | 0.19 | 0.93 | 0.019 | 0.0003 | 0.19 | 50.5 | 28.3 | — | 7.7 | — (N: 0.019) | | | | | |
| 14 | 0.01 | 0.17 | 0.88 | 0.009 | 0.001 | 0.18 | 45.3 | 23.6 | 2.9 | — | Cu: 1.9 (N: 0.013) | 1150 | | 810 | 2.0 | |
| 15 | 0.02 | 0.14 | 0.79 | 0.018 | 0.0008 | 0.17 | 44.2 | 25.6 | 3.1 | — | Y: 0.034, Co: 1.8 (N: 0.018) | | | 920 | 1.0 | |
| 16 | 0.01 | 0.13 | 0.92 | 0.013 | 0.002 | 0.21 | 46.3 | 26.2 | 2.6 | — | La + Ce: 0.023 (N: 0.019) | | | 960 | 1.5 | |
| 17 | 0.03 | 0.18 | 0.76 | 0.016 | 0.001 | 0.19 | 47.9 | 24.8 | 3.3 | — | Mg: 0.014 (N: 0.014) | | | 1030 | 0.5 | |
| 18 | 0.02 | 0.38 | 1.68 | 0.015 | 0.002 | 0.27 | 50.3 | 23.8 | 2.7 | — | Ca: 0.036 | 1200 | | 1050 | 1.0 | |
| 19 | 0.01 | 0.26 | 0.97 | 0.023 | 0.0007 | 0.24 | 51.2 | 25.6 | 2.4 | 0.8 | Ti: 0.32, Mg: 0.009; Y: 0.021 | | | | | |
| 20 | 0.008 | 0.24 | 0.86 | 0.015 | 0.003 | 0.23 | 49.8 | 28.9 | 3.0 | — | Cu: 1.6, Ca: 0.022, Ti: 0.04 | | | | | |
| 21 | 0.01 | 0.27 | 0.89 | 0.017 | 0.001 | 0.25 | 39.7 | 31.2 | 3.1 | — | N: 0.22 | | | | | |
| 22 | 0.02 | 0.29 | 0.71 | 0.018 | 0.002 | 0.10 | 41.2 | 31.9 | 0.6 | 2.6 | N: 0.18, Cu: 1.7, Co: 1.6 | | | | | |
| 23 | 0.01 | 0.15 | 0.76 | 0.017 | 0.001 | 0.17 | 40.6 | 32.6 | 0.7 | 3.1 | N: 0.16, Ca: 0.012, Y: 0.026 | | | | | |
| 24 | 0.03 | 0.17 | 0.73 | 0.023 | 0.002 | 0.16 | 41.3 | 31.8 | 0.9 | 2.3 | N: 0.12, Cu: 1.4, Mg: 0.14 | | | | | |
| Comparative | | | | | | | | | | | | | | | | |
| 1 | 0.01 | 0.16 | 0.69 | 0.021 | 0.003 | 0.15 | 33.8* | 29.6 | 2.2 | — | — (N: 0.017) | | | | | |
| 2 | 0.04 | 0.43 | 0.98 | 0.026 | 0.009* | 0.18 | 46.2 | 36.1* | 2.5 | 1.2 | — (N: 0.014) | | | | | |
| 3 | 0.02 | 0.35 | 0.88 | 0.019 | 0.002 | 0.24 | 38.4 | 29.3 | 1.3* | — | — (N: 0.015) | | | | | |
| 4 | 0.02 | 0.24 | 0.87 | 0.014 | 0.002 | 0.22 | 40.9 | 26.2 | — | 2.6* | — (N: 0.023) | | | | | |
| 5 | 0.02 | 0.14 | 0.96 | 0.014 | 0.001 | 0.16 | 49.2 | 23.8 | 1.3* | — | — (N: 0.028) | | 5* | | | |
| 6 | | | | | | | | | | | | | 30 | 750* | | |
| 7 | | | | | | | | | | | | | | 1150* | | |
| 8 | | | | | | | | | | | | | | 1050 | 5* | |
| 9 | | | | | | | | | | | | | | | | 65* |
| Conventional | | | | | | | | | | | | | | | | |
| 1 | 0.04 | 0.52 | 1.41 | 0.027 | 0.011 | — | 12.8 | 17.2 | 2.4 | — | Cu: 0.1 | | | | | 22 |
| 2 | 0.05 | 0.50 | 1.29 | 0.028 | 0.012 | — | 20.4 | 25.2 | — | — | — | | | | | |
| 3 | 0.05 | 0.52 | 1.10 | 0.016 | 0.008 | 0.32 | 31.8 | 20.5 | — | — | Ti: 0.26 | | | | | |
| 4 | 0.04 | 0.49 | 0.82 | 0.025 | 0.010 | — | 5.4 | 25.4 | 2.2 | — | — | | | | | |

NOTE:
*Outside the range of this invention
**Reduction in thickness for the temperature range of the recrystallizing temperature and below. Nitrogen amounts within the parentheses are those as an impurity.

TABLE 8

| Alloy No. | Cracking during hot working | Cracking in $H_2S$—10 atm $CO_2$ in 20% NaCl at 150° C.: $H_2S$ 0.1 atm | $H_2S$ 1 atm | $H_2S$ 15 atms | 0.2% Offset yield strength (kgf/mm$^2$) | Tensile strength (kgf/mm$^2$) | Elongation (%) | Reduction of area (%) | Impact value (kg · m/cm$^2$ at 0° C.) |
|---|---|---|---|---|---|---|---|---|---|
| This Invention | | | | | | | | | |
| 1 | O | O | O | O | 84.3 | 87.3 | 16 | 79 | 25.6 |
| 2 | | | | | 87.3 | 90.6 | 16 | 80 | 24.7 |
| 3 | | | | | 90.7 | 94.2 | 15 | 76 | 22.6 |
| 4 | | | | | 95.6 | 98.1 | 14 | 72 | 20.3 |
| 5 | | | | | 73.8 | 77.9 | 27 | 83 | 28.9 |
| 6 | | | | | 98.6 | 102.3 | 14 | 71 | 18.3 |
| 7 | | | | | 117.5 | 125.8 | 13 | 72 | 13.6 |

TABLE 8-continued

| Alloy No. | Cracking during hot working | Cracking in $H_2S$—10 atm $CO_2$ in 20% NaCl at 150° C. $H_2S$ 0.1 atm | $H_2S$ 1 atm | $H_2S$ 15 atms | 0.2% Offset yield strength (kgf/mm$^2$) | Tensile strength (kgf/mm$^2$) | Elongation (%) | Reduction of area (%) | Impact value (kg · m/cm$^2$ at 0° C.) |
|---|---|---|---|---|---|---|---|---|---|
| 8 | | | | | 93.5 | 94.8 | 15 | 75 | 19.2 |
| 9 | | | | | 88.6 | 93.3 | 21 | 80 | 23.9 |
| 10 | | | | | 95.5 | 97.8 | 13 | 74 | 17.7 |
| 11 | | | | | 93.6 | 96.4 | 13 | 74 | 18.1 |
| 12 | | | | | 89.7 | 93.1 | 16 | 76 | 21.6 |
| 13 | | | | | 86.3 | 91.5 | 15 | 77 | 24.5 |
| 14 | | | | | 97.2 | 100.5 | 13 | 69 | 12.5 |
| 15 | | | | | 92.6 | 96.3 | 15 | 72 | 14.1 |
| 16 | | | | | 89.4 | 92.6 | 16 | 76 | 22.3 |
| 17 | | | | | 84.4 | 86.5 | 18 | 80 | 24.6 |
| 18 | | | | | 83.1 | 86.8 | 18 | 81 | 25.7 |
| 19 | | | | | 86.9 | 90.8 | 15 | 75 | 18.6 |
| 20 | | | | | 89.6 | 92.5 | 18 | 80 | 23.0 |
| 21 | | | | | 106.5 | 109.6 | 13 | 73 | 14.1 |
| 22 | | | | | 98.5 | 102.7 | 14 | 73 | 12.5 |
| 23 | | | | | 101.5 | 104.6 | 13 | 74 | 14.7 |
| 24 | | | | | 94.6 | 98.6 | 15 | 76 | 13.4 |
| Comparative | | | | | | | | | |
| 1 | | | | X | 83.5 | 86.0 | 14 | 69 | 11.3 |
| 2 | X | — | — | — | — | — | — | — | — |
| 3 | O | O | O | X | 80.2 | 84.1 | 14 | 76 | 19.3 |
| 4 | | | | | 78.6 | 80.3 | 15 | 80 | 21.3 |
| 5 | | | | | 73.1 | 76.9 | 19 | 79 | 27.3 |
| 6 | | | | | 88.6 | 91.3 | 14 | 68 | 4.3 |
| 7 | | | | | 72.6 | 75.7 | 20 | 81 | 29.6 |
| 8 | | | | | 47.5 | 70.6 | 28 | 82 | 31.6 |
| 9 | | | X | | 106.9 | 115.1 | 8 | 54 | 3.6 |
| Conventional | | | | | | | | | |
| 1 | O | X | | | 73.2 | 75.9 | 14 | 75 | 20.6 |
| 2 | | | | | 74.3 | 77.5 | 16 | 78 | 15.1 |
| 3 | | O | | | 76.5 | 78.4 | 14 | 74 | 20.9 |
| 4 | | | | | 92.5 | 94.3 | 12 | 70 | 16.4 |

NOTE:
Alloy Nos. correspond to those of Table 7.

TABLE 9

| Alloy No. | Alloy Composition (Weight %) C | Si | Mn | P | S | sol. Al | Ni | Cr | Mo | W | Others | Hot Working: Heating temp. (°C.) | **Reduction in thickness (%) | Solid solution treatment: Temp. (°C.) | Time (hr) | Reduction in thickness during cold working (%) |
|---|---|---|---|---|---|---|---|---|---|---|---|---|---|---|---|---|
| This Invention | | | | | | | | | | | | | | | | |
| 1 | 0.02 | 0.14 | 0.86 | 0.009 | 0.001 | 0.24 | 50.9 | 25.6 | 6.0 | 0.2 | — | 1200 | 10 | 1050 | 1.0 | 22 |
| 2 | | | | | | | | | | | (N: 0.019) | | 20 | | | |
| 3 | | | | | | | | | | | | | 30 | | | |
| 4 | | | | | | | | | | | | | 50 | | | |
| 5 | | | | | | | | | | | | | 30 | 950 | | 10 |
| 6 | | | | | | | | | | | | | | | | 35 |
| 7 | | | | | | | | | | | | | | | | 60 |
| 8 | 0.03 | 0.18 | 0.77 | 0.024 | 0.001 | 0.18 | 25.9 | 29.6 | 5.6 | 0.6 | — (N: 0.024) | | | 1050 | | 22 |
| 9 | 0.01 | 0.13 | 0.91 | 0.013 | 0.002 | 0.16 | 59.0 | 28.2 | 6.2 | 1.9 | — (N: 0.019) | | | | | |
| 10 | 0.02 | 0.14 | 0.78 | 0.015 | 0.0008 | 0.17 | 41.9 | 23.4 | 6.5 | — | — (N: 0.022) | | | | | |
| 11 | 0.01 | 0.18 | 0.86 | 0.017 | 0.001 | 0.14 | 38.1 | 29.1 | 5.8 | 0.8 | — (N: 0.016) | | | | | |
| 12 | 0.02 | 0.17 | 0.91 | 0.012 | 0.001 | 0.21 | 39.1 | 28.9 | 4.2 | — | — (N: 0.027) | | | | | |
| 13 | 0.01 | 0.33 | 0.51 | 0.018 | 0.0009 | 0.20 | 44.6 | 26.3 | 7.6 | — | — (N: 0.014) | | | | | |
| 14 | 0.02 | 0.27 | 0.67 | 0.016 | 0.003 | 0.21 | 46.3 | 28.6 | — | 8.4 | — (N: 0.025) | | | | | |
| 15 | 0.04 | 0.26 | 0.77 | 0.003 | 0.0005 | 0.23 | 50.2 | 25.2 | — | 15.1 | — (N: 0.023) | | | | | |
| 16 | 0.01 | 0.28 | 0.81 | 0.019 | 0.002 | 0.25 | 48.9 | 28.6 | 3.0 | 6.2 | — (N: 0.011) | | | | | |
| 17 | 0.02 | 0.24 | 0.97 | 0.023 | 0.001 | 0.27 | 46.1 | 23.3 | 5.9 | — | Cu: 1.8 (N: 0.014) | 1150 | | 880 | 2.0 | |
| 18 | 0.01 | 0.24 | 0.98 | 0.017 | 0.001 | 0.26 | 45.1 | 26.5 | 7.1 | — | Cu: 1.7 (N: 0.018) | | | 920 | 1.0 | |

TABLE 9-continued

| Alloy No. | Alloy Composition (Weight %) C | Si | Mn | P | S | sol. Al | Ni | Cr | Mo | W | Others | Hot Working: Heating temp. (°C.) | **Reduction in thickness (%) | Solid solution treatment: Temp. (°C.) | Time (hr) | Reduction in thickness during cold working (%) |
|---|---|---|---|---|---|---|---|---|---|---|---|---|---|---|---|---|
| 19 | 0.01 | 0.26 | 1.53 | 0.014 | 0.0004 | 0.21 | 46.4 | 25.9 | 5.6 | — | La + Ce: 0.024 Y: 0.023 (N: 0.021) | | | 960 | | |
| 20 | 0.02 | 0.22 | 1.02 | 0.017 | 0.002 | 0.19 | 46.8 | 24.9 | 6.4 | — | Mg: 0.015 (N: 0.022) | | | 1080 | 0.5 | |
| 21 | 0.02 | 0.24 | 1.32 | 0.014 | 0.002 | 0.22 | 49.3 | 24.6 | 6.6 | — | Ca: 0.033 | 1200 | | 1050 | | |
| 22 | 0.02 | 0.37 | 1.02 | 0.021 | 0.002 | 0.26 | 52.2 | 26.1 | 5.8 | 0.9 | Ti: 0.38, Mg: 0.012, Y: 0.031 | | | | | |
| 23 | 0.04 | 0.26 | 0.84 | 0.014 | 0.001 | 0.21 | 47.8 | 29.4 | 7.0 | — | Cu: 1.7, Ca: 0.019, Ti: 0.07 | | | | | |
| 24 | 0.01 | 0.24 | 0.88 | 0.018 | 0.001 | 0.27 | 38.9 | 25.6 | 6.2 | — | N: 0.24 | | | | | |
| 25 | 0.02 | 0.29 | 0.70 | 0.017 | 0.0004 | 0.16 | 40.3 | 27.2 | 1.2 | 5.7 | N: 0.14, Cu: 1.6, Co: 1.9 | | | | | |
| 26 | 0.01 | 0.17 | 0.79 | 0.024 | 0.001 | 0.10 | 41.6 | 28.8 | 3.4 | 1.6 | N: 0.17, Ca: 0.014, Y: 0.023 | | | | | |
| 27 | 0.008 | 0.15 | 0.71 | 0.026 | 0.002 | 0.17 | 40.9 | 29.4 | 1.8 | 6.2 | N: 0.12, Cu: 1.4, Mg: 0.014 | | | | | |
| Comparative | | | | | | | | | | | | | | | | |
| 1 | 0.01 | 0.14 | 0.66 | 0.021 | 0.003 | 0.15 | 23.8* | 27.5 | 5.2 | — | — (N: 0.019) | | | | | |
| 2 | 0.02 | 0.34 | 0.97 | 0.019 | 0.006* | 0.18 | 45.6 | 31.4* | 6.5 | — | — (N: 0.017) | | | | | |
| 3 | 0.02 | 0.31 | 0.86 | 0.018 | 0.001 | 0.23 | 37.8 | 28.1 | 3.2* | 1.4 | — (N: 0.015) | | | | | |
| 4 | 0.01 | 0.25 | 0.87 | 0.014 | 0.002 | 0.20 | 40.1 | 23.4 | — | 7.6* | — (N: 0.023) | | | | | |
| 5 | 0.02 | 0.16 | 0.82 | 0.012 | 0.001 | 0.14 | 48.2 | 23.6 | 3.5* | — | — (N: 0.023) | | 7* | | | |
| 6 | | | | | | | | | | | | | 30 | 750* | | |
| 7 | | | | | | | | | | | | | | 1160* | | |
| 8 | | | | | | | | | | | | | | 1050 | | 5* |
| 9 | | | | | | | | | | | | | | | | 65* |

NOTE:
*outside the range of this invention
**Reduction in thickness for the temperature range of the recrystallizing temperature and below. Nitrogen amounts within the parentheses are those as an impurity.

TABLE 10

| Alloy No. | Cracking during hot working | Cracking in $H_2S$—10 atm $CO_2$ in 20% NaCl at 200° C.: $H_2S$ 0.1 atm | $H_2S$ 1 atm | $H_2S$ 15 atms | 0.2% Offset yield strength (kgf/mm$^2$) | Tensile strength (kgf/mm$^2$) | Elongation (%) | Reduction of area (%) | Impact value (kg · m/cm$^2$ at 0° C.) |
|---|---|---|---|---|---|---|---|---|---|
| This Invention | | | | | | | | | |
| 1 | O | O | O | O | 91.3 | 95.5 | 17 | 78 | 22.3 |
| 2 | | | | | 93.6 | 97.0 | 16 | 75 | 21.6 |
| 3 | | | | | 95.2 | 99.4 | 15 | 76 | 22.3 |
| 4 | | | | | 99.6 | 104.2 | 15 | 74 | 20.4 |
| 5 | | | | | 74.2 | 85.3 | 21 | 79 | 23.8 |
| 6 | | | | | 118.6 | 125.1 | 13 | 71 | 11.3 |
| 7 | | | | | 125.7 | 132.7 | 12 | 68 | 7.6 |
| 8 | | | | | 101.8 | 106.4 | 10 | 53 | 6.4 |
| 9 | | | | | 91.5 | 97.5 | 20 | 78 | 18.3 |
| 10 | | | | | 91.4 | 94.6 | 17 | 76 | 6.8 |
| 11 | | | | | 98.4 | 103.6 | 11 | 46 | 5.8 |
| 12 | | | | | 93.4 | 94.8 | 13 | 76 | 16.3 |
| 13 | | | | | 96.3 | 101.4 | 16 | 75 | 17.5 |
| 14 | | | | | 92.1 | 96.3 | 16 | 73 | 19.4 |
| 15 | | | | | 94.3 | 98.4 | 16 | 76 | 17.7 |
| 16 | | | | | 89.2 | 95.4 | 16 | 70 | 13.4 |
| 17 | | | | | 98.1 | 102.5 | 11 | 60 | 5.9 |
| 18 | | | | | 96.3 | 99.1 | 12 | 64 | 7.6 |
| 19 | | | | | 94.1 | 97.6 | 13 | 69 | 10.4 |
| 20 | | | | | 89.4 | 92.3 | 15 | 78 | 16.4 |
| 21 | | | | | 94.8 | 98.6 | 15 | 70 | 14.9 |
| 22 | | | | | 95.0 | 100.3 | 16 | 72 | 16.3 |
| 23 | | | | | 89.6 | 95.7 | 19 | 76 | 19.1 |

TABLE 10-continued

| Alloy No. | Cracking during hot working | Cracking in $H_2S$—10 atm $CO_2$ in 20% NaCl at 200° C. $H_2S$ 0.1 atm | $H_2S$ 1 atm | $H_2S$ 15 atms | 0.2% Offset yield strength (kgf/mm²) | Tensile strength (kgf/mm²) | Elongation (%) | Reduction of area (%) | Impact value (kg · m/cm² at 0° C.) |
|---|---|---|---|---|---|---|---|---|---|
| 24 | | | | | 107.4 | 112.3 | 15 | 72 | 18.6 |
| 25 | | | | | 94.4 | 97.8 | 17 | 77 | 20.1 |
| 26 | | | | | 104.7 | 108.9 | 15 | 72 | 14.6 |
| 27 | | | | | 107.6 | 114.3 | 10 | 48 | 15.6 |
| Comparative | | | | | | | | | |
| 1 | | | | X | 98.8 | 104.2 | 6 | 29 | 0.5 |
| 2 | X | — | — | — | — | — | — | — | — |
| 3 | O | O | O | X | 89.3 | 91.6 | 13 | 72 | 12.6 |
| 4 | | | | | 80.6 | 83.5 | 15 | 75 | 14.9 |
| 5 | | | | | 91.3 | 95.5 | 14 | 68 | 10.7 |
| 6 | | | X | | 99.6 | 103.9 | 6 | 46 | 1.4 |
| 7 | | | O | | 82.4 | 87.5 | 17 | 78 | 23.4 |
| 8 | | | | | 49.3 | 78.6 | 31 | 81 | 27.5 |
| 9 | | | | | 138.4 | 131.2 | 8 | 54 | 1.8 |

NOTE:
Alloy Nos. correspond to those of Table 9.

TABLE 11

| Alloy No. | Alloy Composition (Weight %) C | Si | Mn | P | S | sol. Al | Ni | Cr | Mo | W | Others | Hot Working Heating temp. (°C.) | **Reduction in thickness (%) | Solid solution treatment Temp. (°C.) | Time (hr) | Reduction in thickness during cold working (%) |
|---|---|---|---|---|---|---|---|---|---|---|---|---|---|---|---|---|
| This Invention | | | | | | | | | | | | | | | | |
| 1 | 0.01 | 0.16 | 0.78 | 0.012 | 0.001 | 0.17 | 51.2 | 25.1 | 9.7 | — | — (N: 0.012) | 1200 | 10 | 1100 | 1.0 | 22 |
| 2 | | | | | | | | | | | | | 20 | | | |
| 3 | | | | | | | | | | | | | 30 | | | |
| 4 | | | | | | | | | | | | | 50 | | | |
| 5 | | | | | | | | | | | | | 30 | 1000 | | 10 |
| 6 | | | | | | | | | | | | | | | | 35 |
| 7 | | | | | | | | | | | | | | | | 60 |
| 8 | 0.02 | 0.33 | 0.77 | 0.22 | 0.001 | 0.19 | 30.8 | 23.8 | 9.9 | 0.4 | — (N: 0.15) | | | 1080 | | 22 |
| 9 | 0.03 | 0.26 | 0.84 | 0.019 | 0.0009 | 0.22 | 59.4 | 26.2 | 7.6 | 1.6 | — (N: 0.025) | | | | | |
| 10 | 0.04 | 0.25 | 0.90 | 0.011 | 0.003 | 0.17 | 36.2 | 16.0 | 10.3 | 0.8 | — (N: 0.020) | | | | | |
| 11 | 0.01 | 0.18 | 0.49 | 0.021 | 0.0005 | 0.24 | 38.3 | 29.7 | 6.1 | 4.0 | — (N: 0.013) | | | | | |
| 12 | 0.02 | 0.13 | 0.66 | 0.015 | 0.002 | 0.15 | 42.3 | 21.6 | 11.9 | — | — (N: 0.025) | | | | | |
| 13 | 0.02 | 0.23 | 0.76 | 0.014 | 0.001 | 0.28 | 50.2 | 27.2 | — | 16.8 | — (N: 0.017) | | | | | |
| 14 | 0.01 | 0.14 | 0.97 | 0.010 | 0.002 | 0.16 | 49.6 | 19.2 | — | 23.5 | — (N: 0.013) | | | | | |
| 15 | 0.02 | 0.25 | 0.78 | 0.016 | 0.001 | 0.27 | 45.2 | 20.6 | 5.2 | 10.6 | — (N: 0.015) | | | | | |
| 16 | 0.02 | 0.18 | 0.81 | 0.011 | 0.007 | 0.13 | 55.3 | 24.6 | 9.6 | — | Cu: 1.6 (N: 0.016) | 1150 | | 880 | 2.0 | |
| 17 | 0.01 | 0.24 | 1.52 | 0.014 | 0.0004 | 0.20 | 56.2 | 23.2 | 10.2 | — | Co: 1.8 (N: 0.022) | | | 950 | 1.0 | |
| 18 | 0.01 | 0.15 | 0.96 | 0.009 | 0.001 | 0.20 | 53.1 | 25.2 | 6.3 | 4.6 | La + Ce: 0.022, Y: 0.016 (N: 0.021) | | | 1000 | | |
| 19 | 0.01 | 0.22 | 0.95 | 0.002 | 0.002 | 0.22 | 54.3 | 24.6 | 5.8 | 5.6 | Mg: 0.014 (N: 0.022) | | | 1120 | 0.5 | |
| 20 | 0.04 | 0.17 | 0.79 | 0.025 | 0.001 | 0.17 | 35.3 | 19.6 | 9.4 | — | Ca: 0.024 | 1200 | | 1100 | 1.0 | |
| 21 | 0.01 | 0.24 | 0.68 | 0.013 | 0.001 | 0.2 | 40.2 | 25.2 | 8.6 | — | Ti: 0.39, Mg: 0.021 Y: 0.025 | | | | | |
| 22 | 0.02 | 0.16 | 1.28 | 0.003 | 0.0004 | 0.09 | 42.3 | 20.5 | 10.1 | — | Cu: 1.9, Ca: 0.018, Ti: 0.06 | | | | | |
| 23 | 0.02 | 0.35 | 0.63 | 0.020 | 0.002 | 0.18 | 50.6 | 25.6 | 9.2 | — | N: 0.23 | | | | | |
| 24 | 0.01 | 0.15 | 0.82 | 0.021 | 0.002 | 0.25 | 51.2 | 24.2 | 6.4 | 5.7 | N: 0.12, Cu: 1.8, Co: 1.7 | | | | | |
| 25 | 0.008 | 0.26 | 0.96 | 0.019 | 0.003 | 0.14 | 55.3 | 26.1 | 3.6 | 9.6 | N: 0.09, Ca: 0.035, Y: 0.022 | | | | | |

TABLE 11-continued

| Alloy No. | Alloy Composition (Weight %) C | Si | Mn | P | S | sol. Al | Ni | Cr | Mo | W | Others | Hot Working: Heating temp. (°C.) | **Reduction in thickness (%) | Solid solution treatment: Temp. (°C.) | Time (hr) | Reduction in thickness during cold working (%) |
|---|---|---|---|---|---|---|---|---|---|---|---|---|---|---|---|---|
| 26 | 0.02 | 0.33 | 0.86 | 0.019 | 0.001 | 0.18 | 54.9 | 27.2 | 7.3 | 2.4 | N: 0.19, Cu: 1.4, Mg: 0.010 | | | | | |
| Comparative | | | | | | | | | | | | | | | | |
| 1 | 0.02 | 0.24 | 0.83 | 0.015 | 0.003 | 0.20 | 1050 | 25.2 | 8.3 | 0.6 | — (N: 0.019) | | | | | |
| 2 | 0.01 | 0.28 | 0.87 | 0.018 | 0.011 | 0.22 | 40.3 | 31.6* | 9.2 | — | — (N: 0.022) | | | | | |
| 3 | 0.03 | 0.31 | 0.76 | 0.023 | 0.001 | 0.26 | 51.2 | 28.3 | 7.5* | — | — (N: 0.031) | | | | | |
| 4 | 0.01 | 0.23 | 0.87 | 0.013 | 0.002 | 0.19 | 45.3 | 25.1 | — | 15.1* | — (N: 0.024) | | | | | |
| 5 | 0.01 | 0.12 | 0.79 | 0.009 | 0.002 | 0.18 | 49.7 | 20.6 | 7.3* | 0.2 | — (N: 0.030) | | 7* | | | |
| 6 | | | | | | | | | | | | | 30 | 750* | | |
| 7 | | | | | | | | | | | | | | 1160* | | |
| 8 | | | | | | | | | | | | | | | | 5* |
| 9 | | | | | | | | | | | | | | 1050 | | 65* |

NOTE:
*Outside the range of this invention
**Reduction in thickness for the temperature range of the recrystallizing temperature and below. Amounts of nitrogen within the parentheses are those as an impurity.

TABLE 12

| Alloy No. | Cracking during hot working | Cracking in $H_2S$—10 atm $CO_2$ in 20% NaCl at 300° C.: $H_2S$ 0.1 atm | $H_2S$ 1 atm | $H_2S$ 15 atms | 0.2% Offset yield strength (kgf/mm$^2$) | Tensile strength (kgf/mm$^2$) | Elongation (%) | Reduction of area (%) | Impact value (kg · m/cm$^2$ at 0° C.) |
|---|---|---|---|---|---|---|---|---|---|
| This Invention | | | | | | | | | |
| 1 | O | O | O | O | 89.8 | 96.4 | 19 | 73 | 18.9 |
| 2 | | | | | 91.0 | 94.8 | 19 | 74 | 17.2 |
| 3 | | | | | 95.6 | 101.2 | 17 | 71 | 14.6 |
| 4 | | | | | 97.6 | 103.1 | 18 | 70 | 13.7 |
| 5 | | | | | 70.4 | 81.2 | 26 | 76 | 21.6 |
| 6 | | | | | 100.9 | 108.2 | 14 | 67 | 9.6 |
| 7 | | | | | 127.6 | 133.2 | 11 | 56 | 5.2 |
| 8 | | | | | 88.6 | 92.6 | 10 | 45 | 6.9 |
| 9 | | | | | 93.6 | 96.9 | 13 | 69 | 11.7 |
| 10 | | | | | 84.4 | 91.0 | 17 | 76 | 21.3 |
| 11 | | | | | 96.2 | 101.6 | 10 | 45 | 7.4 |
| 12 | | | | | 91.3 | 96.2 | 15 | 63 | 8.9 |
| 13 | | | | | 89.6 | 95.4 | 18 | 74 | 19.1 |
| 14 | | | | | 91.1 | 95.6 | 18 | 76 | 22.1 |
| 15 | | | | | 92.4 | 96.4 | 14 | 63 | 9.6 |
| 16 | | | | | 98.4 | 103.6 | 17 | 74 | 19.2 |
| 17 | | | | | 95.8 | 99.1 | 17 | 76 | 20.6 |
| 18 | | | | | 97.0 | 102.4 | 15 | 71 | 18.4 |
| 19 | | | | | 94.3 | 98.5 | 16 | 76 | 19.3 |
| 20 | | | | | 91.4 | 95.6 | 15 | 66 | 9.6 |
| 21 | | | | | 93.4 | 96.6 | 15 | 78 | 7.6 |
| 22 | | | | | 92.8 | 98.1 | 11 | 60 | 7.6 |
| 23 | | | | | 109.8 | 116.1 | 12 | 54 | 10.4 |
| 24 | | | | | 99.6 | 103.5 | 14 | 66 | 16.6 |
| 25 | | | | | 100.1 | 105.9 | 13 | 69 | 11.4 |
| 26 | | | | | 109.4 | 113.6 | 16 | 71 | 9.8 |
| Comparative | | | | | | | | | |
| 1 | | | X | X | 98.8 | 104.2 | 6 | 28 | 0.6 |
| 2 | X | — | — | — | — | — | — | — | — |
| 3 | O | O | X | X | 92.6 | 96.4 | 17 | 72 | 14.3 |
| 4 | | | | | 91.3 | 95.5 | 15 | 71 | 10.7 |
| 5 | | | O | | 86.8 | 91.3 | 14 | 74 | 22.7 |
| 6 | | | | | 102.6 | 106.3 | 8 | 42 | 3.8 |
| 7 | | | | | 84.1 | 89.3 | 14 | 78 | 23.3 |
| 8 | | | | | 45.6 | 76.2 | 28 | 80 | 27.6 |
| 9 | | | | | 120.4 | 126.6 | 7 | 56 | 3.0 |

NOTE:
Alloy Nos. correspond to those of Table 11.

TABLE 13

| Alloy No. | Alloy Composition (Weight %) C | Si | Mn | P | S | sol. Al | Ni | Cr | Mo | W | Others | Hot Working Heating Temp. (°C.) | **Reduction in thickness (%) | Finishing Temp. (°C.) | Reduction in thickness during cold working (%) |
|---|---|---|---|---|---|---|---|---|---|---|---|---|---|---|---|
| This Invention | | | | | | | | | | | | | | | |
| 1 | 0.01 | 0.23 | 0.87 | 0.009 | 0.001 | 0.20 | 56.5 | 25.6 | 3.1 | — | — (N: 0.018) | 1050 | 30 | 900 | 22 |
| 2 | | | | | | | | | | | | 1250 | | | |
| 3 | | | | | | | | | | | | 1200 | 10 | | |
| 4 | | | | | | | | | | | | | 50 | | |
| 5 | | | | | | | | | | | | | 30 | | 15 |
| 6 | | | | | | | | | | | | | | | 35 |
| 7 | | | | | | | | | | | | | | | 60 |
| 8 | 0.03 | 0.25 | 0.72 | 0.025 | 0.002 | 0.16 | 35.4 | 29.3 | 3.3 | — | — (N: 0.027) | | | | 22 |
| 9 | 0.02 | 0.27 | 0.56 | 0.018 | 0.002 | 0.14 | 59.1 | 28.6 | 3.8 | — | — (N: 0.019) | | | | |
| 10 | 0.01 | 0.10 | 0.73 | 0.012 | 0.001 | 0.19 | 40.3 | 23.2 | 2.6 | 1.2 | — (N: 0.014) | | | | |
| 11 | 0.01 | 0.09 | 0.68 | 0.002 | 0.001 | 0.17 | 41.2 | 34.5 | 1.5 | 1.0 | — (N: 0.017) | | | | |
| 12 | 0.04 | 0.16 | 0.54 | 0.015 | 0.003 | 0.09 | 39.6 | 33.6 | 1.7 | — | — (N: 0.022) | | | | |
| 13 | 0.01 | 0.14 | 0.72 | 0.024 | 0.001 | 0.23 | 50.6 | 25.9 | 3.9 | — | — (N: 0.035) | | | | |
| 14 | 0.01 | 0.13 | 0.98 | 0.016 | 0.001 | 0.38 | 51.2 | 34.6 | — | 3.2 | — (N: 0.027) | | | | |
| 15 | 0.009 | 0.21 | 0.75 | 0.019 | 0.0005 | 0.16 | 49.3 | 25.3 | — | 7.8 | — (N: 0.019) | | | | |
| 16 | 0.02 | 0.22 | 1.76 | 0.003 | 0.0007 | 0.25 | 47.6 | 25.3 | 2.7 | — | Cu: 1.8 (N: 0.016) | | | 820 | |
| 17 | 0.01 | 0.27 | 0.89 | 0.016 | 0.002 | 0.16 | 55.4 | 24.9 | 3.5 | — | Y: 0.044, Co: 1.7 (N: 0.017) | | | 880 | |
| 18 | 0.01 | 0.38 | 0.77 | 0.012 | 0.001 | 0.12 | 54.2 | 23.6 | 3.1 | — | La + Ce: 0.024 (N: 0.012) | | | 920 | |
| 19 | 0.02 | 0.43 | 0.76 | 0.010 | 0.001 | 0.19 | 56.3 | 25.2 | 3.3 | — | Mg: 0.012 (N: 0.016) | | | 950 | |
| 20 | 0.03 | 0.27 | 0.64 | 0.019 | 0.001 | 0.46 | 41.2 | 25.6 | 2.9 | — | Ti: 0.36, Mg: 0.009, Y: 0.021 | | | 900 | |
| 21 | 0.01 | 0.16 | 0.96 | 0.003 | 0.003 | 0.16 | 50.3 | 27.2 | 3.3 | — | Cu: 1.7, Ca: 0.018, Ti: 0.04 | | | | |
| 22 | 0.009 | 0.14 | 0.88 | 0.014 | 0.001 | 0.14 | 51.2 | 29.6 | 3.4 | — | N: 0.23 | | | | |
| 23 | 0.01 | 0.18 | 0.72 | 0.017 | 0.002 | 0.27 | 49.6 | 30.1 | 1.9 | 0.8 | N: 0.17, Cu: 1.6, Co: 1.9 | | | | |
| 24 | 0.005 | 0.19 | 0.89 | 0.016 | 0.001 | 0.19 | 45.6 | 33.2 | 1.2 | 3.5 | N: 0.12, Ca: 0.025, Y: 0.031 | | | | |
| 25 | 0.01 | 0.21 | 0.71 | 0.015 | 0.001 | 0.31 | 50.2 | 30.6 | — | 4.3 | N: 0.19, Cu: 1.6, Mg: 0.014 | | | | |
| Comparative | | | | | | | | | | | | | | | |
| 1 | 0.02 | 0.27 | 0.89 | 0.023 | 0.002 | 0.25 | 32.8* | 27.5 | 2.5 | — | — (N: 0.016) | | | | |
| 2 | 0.02 | 0.11 | 0.66 | 0.016 | 0.013* | 0.16 | 40.6 | 36.4* | 3.1 | — | — (N: 0.018) | | | | |
| 3 | 0.01 | 0.21 | 0.54 | 0.025 | 0.003 | 0.34 | 42.6 | 30.9 | 1.2* | — | — (N: 0.014) | | | | |
| 4 | 0.01 | 0.33 | 0.18 | 0.012 | 0.001 | 0.14 | 50.6 | 29.4 | — | 2.5* | — (N: 0.019) | | | | |
| 5 | 0.02 | 0.38 | 0.64 | 0.023 | 0.003 | 0.19 | 41.5 | 23.6 | 1.2* | 0.2 | — (N: 0.014) | 950* | | | |
| 6 | | | | | | | | | | | | 1200 | 5* | | |
| 7 | | | | | | | | | | | | | 30 | 750* | |
| 8 | | | | | | | | | | | | | | 900 | 5* |
| 9 | | | | | | | | | | | | | | | 65* |
| Conventional | | | | | | | | | | | | | | | |
| 1 | 0.04 | 0.52 | 1.41 | 0.027 | 0.011 | — | 12.8 | 17.2 | 2.4 | — | Cu: 0.1 | | | 980 | 22 |
| 2 | 0.05 | 0.50 | 1.29 | 0.028 | 0.012 | — | 20.4 | 25.2 | — | — | — | | | 970 | |
| 3 | 0.05 | 0.52 | 1.10 | 0.016 | 0.008 | 0.32 | 31.8 | 20.5 | — | — | Ti: 0.26 | | | 950 | |
| 4 | 0.04 | 0.49 | 0.82 | 0.025 | 0.010 | — | 5.4 | 25.4 | 2.2 | — | — | | | 1000 | |

NOTE:
*Outside the range of this invention
**Reduction in thickness for the temperature of 1000° C. and below.

TABLE 14

| Alloy No. | Cracking during hot working | Cracking in $H_2S$—atm $CO_2$ in 20% NaCl at 150° C. $H_2S$ 0.1 atm | $H_2S$ 1 atm | $H_2S$ 15 atms | 0.2% Offset yield strength (kgf/mm²) | Tensile strength (kgf/mm²) | Elongation (%) | Reduction of area (%) | Impact value (kg.m/cm² at 0° C.) |
|---|---|---|---|---|---|---|---|---|---|
| This Invention | | | | | | | | | |
| 1 | O | O | O | O | 90.5 | 93.8 | 16 | 68 | 25.9 |
| 2 | | | | | 88.9 | 92.5 | 18 | 72 | 28.3 |
| 3 | | | | | 85.9 | 89.2 | 20 | 78 | 29.4 |
| 4 | | | | | 94.1 | 98.3 | 15 | 62 | 21.3 |
| 5 | | | | | 85.3 | 88.6 | 19 | 78 | 27.6 |
| 6 | | | | | 101.0 | 108.4 | 14 | 58 | 16.4 |
| 7 | | | | | 133.3 | 139.2 | 9 | 46 | 5.3 |
| 8 | | | | | 98.3 | 101.2 | 13 | 74 | 18.6 |
| 9 | | | | | 93.5 | 99.1 | 19 | 75 | 16.7 |
| 10 | | | | | 90.3 | 93.5 | 15 | 75 | 18.9 |
| 11 | | | | | 99.7 | 103.6 | 12 | 72 | 17.1 |
| 12 | | | | | 96.4 | 100.2 | 15 | 72 | 16.7 |

TABLE 14-continued

| Alloy No. | Cracking during hot working | Cracking in $H_2S$—atm $CO_2$ in 20% NaCl at 150° C. $H_2S$ 0.1 atm | $H_2S$ 1 atm | $H_2S$ 15 atms | 0.2% Offset yield strength (kgf/mm$^2$) | Tensile strength (kgf/mm$^2$) | Elongation (%) | Reduction of area (%) | Impact value (kg.m/cm$^2$ at 0° C.) |
|---|---|---|---|---|---|---|---|---|---|
| 13 | | | | | 93.6 | 97.4 | 15 | 75 | 16.9 |
| 14 | | | | | 90.6 | 94.2 | 16 | 77 | 18.4 |
| 15 | | | | | 94.2 | 98.3 | 15 | 72 | 14.8 |
| 16 | | | | | 96.9 | 101.8 | 13 | 64 | 7.3 |
| 17 | | | | | 93.6 | 97.7 | 18 | 80 | 23.1 |
| 18 | | | | | 90.5 | 94.6 | 16 | 70 | 23.4 |
| 19 | | | | | 87.5 | 91.2 | 17 | 74 | 14.2 |
| 20 | | | | | 90.3 | 93.6 | 15 | 75 | 16.9 |
| 21 | | | | | 95.0 | 98.3 | 14 | 70 | 12.7 |
| 22 | | | | | 109.2 | 114.3 | 16 | 68 | 9.3 |
| 23 | | | | | 104.5 | 109.6 | 12 | 63 | 8.1 |
| 24 | | | | | 102.5 | 106.6 | 13 | 73 | 12.5 |
| 25 | | | | | 109.6 | 114.2 | 11 | 54 | 6.6 |
| Comparative | | | | | | | | | |
| 1 | | | | X | 89.5 | 94.0 | 14 | 68 | 8.6 |
| 2 | X | — | — | — | — | — | — | — | — |
| 3 | O | O | O | X | 88.6 | 92.5 | 13 | 72 | 12.5 |
| 4 | | | | | 88.2 | 89.9 | 14 | 76 | 16.4 |
| 5 | X | — | — | — | — | — | — | — | — |
| 6 | O | O | O | X | 81.5 | 84.0 | 14 | 69 | 13.3 |
| 7 | | | | | 96.6 | 100.3 | 6 | 43 | 3.1 |
| 8 | | | | | 43.1 | 78.5 | 26 | 82 | 23.7 |
| 9 | | | | | 132.2 | 138.5 | 4 | 21 | 2.0 |
| Conventional | | | | | | | | | |
| 1 | | X | X | | 78.2 | 82.9 | 13 | 78 | 22.3 |
| 2 | | | | | 79.3 | 84.1 | 15 | 78 | 16.4 |
| 3 | | O | | | 80.3 | 83.5 | 12 | 72 | 18.8 |
| 4 | | | | | 93.6 | 96.1 | 11 | 69 | 15.8 |

NOTE:
Alloy Nos. correspond to those of Table 13.

TABLE 15

| Alloy No. | Alloy Composition (Weight %) C | Si | Mn | P | S | sol. Al | Ni | Cr | Mo | W | Others | Hot Working Heating Temp. (°C.) | **Reduction in thickness (%) | Finishing Temp. (°C.) | Reduction in thickness during cold working (%) |
|---|---|---|---|---|---|---|---|---|---|---|---|---|---|---|---|
| This Invention | | | | | | | | | | | | | | | |
| 1 | 0.01 | 0.25 | 0.68 | 0.016 | 0.002 | 0.19 | 55.4 | 25.4 | 6.2 | — | — (N: 0.025) | 1050 | 30 | 900 | 22 |
| 2 | | | | | | | | | | | | 1250 | | | |
| 3 | | | | | | | | | | | | 1200 | 10 | | |
| 4 | | | | | | | | | | | | | 50 | | |
| 5 | | | | | | | | | | | | | | | 15 |
| 6 | | | | | | | | | | | | | 30 | | 35 |
| 7 | | | | | | | | | | | | | | | 60 |
| 8 | 0.009 | 0.13 | 0.70 | 0.024 | 0.001 | 0.37 | 25.2 | 28.1 | 5.3 | — | — (N: 0.029) | | | | 22 |
| 9 | 0.03 | 0.25 | 0.99 | 0.007 | 0.0005 | 0.12 | 59.3 | 29.2 | 5.8 | — | — (N: 0.021) | | | | |
| 10 | 0.02 | 0.21 | 0.76 | 0.012 | 0.002 | 0.24 | 41.2 | 23.0 | 4.6 | 2.2 | — (N: 0.017) | | | | |
| 11 | 0.02 | 0.24 | 0.58 | 0.019 | 0.001 | 0.16 | 43.0 | 29.8 | 3.7 | 1.4 | — (N: 0.014) | | | | |
| 12 | 0.02 | 0.27 | 0.73 | 0.025 | 0.001 | 0.14 | 40.6 | 29.6 | 4.1 | — | — (N: 0.025) | | | | |
| 13 | 0.01 | 0.22 | 0.75 | 0.024 | 0.002 | 0.09 | 50.9 | 26.8 | 7.7 | — | — (N: 0.039) | | | | |
| 14 | 0.01 | 0.10 | 0.74 | 0.019 | 0.003 | 0.23 | 51.4 | 29.6 | — | 8.4 | — (N: 0.022) | | | | |
| 15 | 0.04 | 0.27 | 0.70 | 0.003 | 0.001 | 0.25 | 49.6 | 24.3 | — | 15.3 | — (N: 0.019) | | | | |
| 16 | 0.01 | 0.15 | 0.56 | 0.014 | 0.002 | 0.41 | 45.4 | 26.4 | 5.8 | — | Cu: 1.9 (N: 0.014) | | | 820 | |
| 17 | 0.02 | 0.39 | 0.88 | 0.002 | 0.0005 | 0.18 | 55.6 | 23.8 | 5.4 | — | Co: 1.8 (N: 0.016) | | | 870 | |
| 18 | 0.01 | 0.14 | 0.76 | 0.010 | 0.002 | 0.16 | 56.3 | 25.4 | 6.1 | — | La + Ce: 0.016, Y: 0.034 (N: 0.016) | | | 920 | |
| 19 | 0.01 | 0.41 | 0.75 | 0.013 | 0.001 | 0.16 | 55.1 | 27.6 | 5.8 | — | Mg: 0.009 (N: 0.014) | | | 960 | |
| 20 | 0.01 | 0.21 | 0.76 | 0.013 | 0.002 | 0.33 | 41.5 | 24.6 | 5.8 | — | Ca: 0.042 | | | 900 | |
| 21 | 0.005 | 0.31 | 0.89 | 0.025 | 0.001 | 0.23 | 42.6 | 26.4 | 4.9 | — | Ti: 0.44, Mg: 0.016, Y: 0.015 | | | | |
| 22 | 0.01 | 0.20 | 0.69 | 0.003 | 0.001 | 0.14 | 49.6 | 29.9 | 5.4 | — | N: 0.24 | | | | |
| 23 | 0.01 | 0.10 | 0.98 | 0.017 | 0.003 | 0.34 | 52.3 | 26.8 | 3.8 | 4.6 | N: 0.18, Cu: 1.4, Co: 1.8 | | | | |
| 24 | 0.03 | 0.12 | 0.87 | 0.013 | 0.002 | 0.17 | 46.8 | 27.6 | 4.2 | 4.1 | N: 0.11, Ca: 0.025, Y: 0.034 | | | | |
| 25 | 0.02 | 0.24 | 0.64 | 0.015 | 0.003 | 0.25 | 51.3 | 23.6 | — | 12.6 | N: 0.18, Cu: 1.7, Mg: 0.021 | | | | |
| Comparative | | | | | | | | | | | | | | | |
| 1 | 0.01 | 0.35 | 0.66 | 0.019 | 0.001 | 0.31 | 24.1* | 25.4 | 4.6 | — | — (N: 0.018) | | | | |

TABLE 15-continued

| Alloy No. | Alloy Composition (Weight %) C | Si | Mn | P | S | sol. Al | Ni | Cr | Mo | W | Others | Hot Working Heating Temp. (°C.) | **Reduction in thickness (%) | Finishing Temp. (°C.) | Reduction in thickness during cold working (%) |
|---|---|---|---|---|---|---|---|---|---|---|---|---|---|---|---|
| 2 | 0.01 | 0.14 | 0.59 | 0.023 | 0.009 | 0.19 | 30.6 | 31.5* | 5.3 | — | — (N: 0.014) | | | | |
| 3 | 0.009 | 0.39 | 0.19 | 0.021 | 0.001 | 0.43 | 41.5 | 26.4 | 3.7* | — | — (N: 0.016) | | | | |
| 4 | 0.01 | 0.25 | 0.76 | 0.014 | 0.002 | 0.14 | 36.8 | 25.3 | — | 7.6* | — (N: 0.023) | | | | |
| 5 | 0.02 | 0.34 | 0.76 | 0.021 | 0.002 | 0.18 | 39.5 | 23.9 | 4.3 | — | — (N: 0.027) | 950* | 15 | | |
| 6 | | | | | | | | | | | | 1200 | 5* | | |
| 7 | | | | | | | | | | | | | 30 | 750* | |
| 8 | | | | | | | | | | | | | | 900 | 5* |
| 9 | | | | | | | | | | | | | | | 65* |

NOTE:
*Outside the range of this invention
**Reduction in thickness for the temperature of 1000° C. and below. Nitrogen amounts within the parentheses are those as an impurity.

TABLE 16

| Alloy No. | Cracking during hot working | Cracking in $H_2S$—10 atm $CO_2$ in 20% NaCl at 200° C. $H_2S$ 0.1 atm | $H_2S$ 1 atm | $H_2S$ 15 atms | 0.2% Offset yield strength (kgf/mm$^2$) | Tensile strength (kgf/mm$^2$) | Elongation (%) | Reduction of area (%) | Impact value (kg.m/cm$^2$ at 0° C.) |
|---|---|---|---|---|---|---|---|---|---|
| This Invention | | | | | | | | | |
| 1 | O | O | O | O | 97.1 | 102.5 | 13 | 65 | 14.4 |
| 2 | | | | | 95.7 | 101.5 | 16 | 74 | 19.1 |
| 3 | | | | | 94.0 | 99.4 | 16 | 77 | 21.8 |
| 4 | | | | | 99.6 | 105.4 | 14 | 69 | 16.7 |
| 5 | | | | | 86.2 | 91.9 | 17 | 77 | 23.4 |
| 6 | | | | | 103.6 | 108.3 | 15 | 70 | 12.2 |
| 7 | | | | | 128.4 | 134.6 | 11 | 56 | 5.7 |
| 8 | | | | | 87.5 | 91.0 | 13 | 68 | 10.2 |
| 9 | | | | | 95.1 | 101.7 | 18 | 72 | 16.8 |
| 10 | | | | | 88.2 | 91.3 | 15 | 78 | 18.3 |
| 11 | | | | | 92.7 | 96.2 | 17 | 76 | 20.9 |
| 12 | | | | | 89.4 | 94.5 | 19 | 76 | 21.1 |
| 13 | | | | | 94.3 | 98.5 | 17 | 78 | 22.3 |
| 14 | | | | | 91.6 | 95.6 | 18 | 79 | 21.6 |
| 15 | | | | | 95.1 | 99.2 | 15 | 67 | 16.4 |
| 16 | | | | | 99.6 | 105.1 | 13 | 62 | 9.3 |
| 17 | | | | | 96.0 | 101.5 | 14 | 69 | 18.8 |
| 18 | | | | | 94.6 | 98.6 | 17 | 76 | 19.2 |
| 19 | | | | | 90.7 | 95.6 | 17 | 75 | 16.1 |
| 20 | | | | | 81.4 | 94.6 | 15 | 78 | 8.3 |
| 21 | | | | | 96.3 | 101.4 | 16 | 74 | 19.7 |
| 22 | | | | | 110.4 | 113.8 | 13 | 64 | 9.2 |
| 23 | | | | | 108.4 | 113.7 | 12 | 63 | 10.5 |
| 24 | | | | | 102.5 | 106.4 | 13 | 65 | 10.7 |
| 25 | | | | | 113.0 | 116.4 | 11 | 59 | 11.2 |
| Comparative | | | | | | | | | |
| 1 | | | | X | 86.5 | 90.4 | 13 | 67 | 8.2 |
| 2 | X | — | — | — | — | — | — | — | — |
| 3 | O | O | O | X | 87.3 | 90.8 | 15 | 69 | 21.4 |
| 4 | | | | | 88.1 | 92.6 | 12 | 65 | 7.6 |
| 5 | | | | | 93.1 | 98.6 | 6 | 30 | 3.2 |
| 6 | | | | | 80.1 | 83.1 | 17 | 79 | 23.1 |
| 7 | X | — | — | — | — | — | — | — | — |
| 8 | O | O | X | | 44.6 | 70.3 | 32 | 80 | 26.4 |
| 9 | | | O | | 133.5 | 139.1 | 4 | 17 | 2.6 |
| Conventional | | | | | | | | | |
| 1 | | X | | X | 77.2 | 78.6 | 12 | 70 | 18.8 |
| 2 | | | | | 78.9 | 82.3 | 15 | 69 | 13.9 |
| 3 | | | | | 77.5 | 82.5 | 13 | 74 | 18.2 |
| 4 | | O | | | 96.2 | 99.1 | 11 | 67 | 12.1 |

NOTE:
Alloy Nos. correspond to those of Table 15.

TABLE 17

| Alloy No. | Alloy Composition (Weight %) C | Si | Mn | P | S | sol. Al | Ni | Cr | Mo | W | Others | Hot Working Heating Temp. (°C.) | **Reduction in thickness (%) | Finishing Temp. (°C.) | Reduction in thickness during cold working (%) |
|---|---|---|---|---|---|---|---|---|---|---|---|---|---|---|---|
| This Invention | | | | | | | | | | | | | | | |

TABLE 17-continued

| Alloy No. | Alloy Composition (Weight %) C | Si | Mn | P | S | sol. Al | Ni | Cr | Mo | W | Others | Hot Working Heating Temp. (°C.) | **Reduction in thickness (%) | Finishing Temp. (°C.) | Reduction in thickness during cold working (%) |
|---|---|---|---|---|---|---|---|---|---|---|---|---|---|---|---|
| 1 | 0.01 | 0.16 | 0.58 | 0.023 | 0.001 | 0.17 | 51.2 | 20.7 | 10.5 | — | — (N: 0.026) | 1050 | 30 | 900 | 22 |
| 2 | | | | | | | | | | | | 1250 | | | |
| 3 | | | | | | | | | | | | 1200 | 10 | | |
| 4 | | | | | | | | | | | | | 50 | | |
| 5 | | | | | | | | | | | | | | | 15 |
| 6 | | | | | | | | | | | | | 30 | | 35 |
| 7 | | | | | | | | | | | | | | | 60 |
| 8 | 0.02 | 0.37 | 0.67 | 0.021 | 0.003 | 0.13 | 30.6 | 24.6 | 9.4 | — | — (N: 0.019) | | | | 22 |
| 9 | 0.009 | 0.26 | 0.69 | 0.004 | 0.002 | 0.44 | 59.2 | 23.9 | 10.4 | — | — (N: 0.016) | | | | |
| 10 | 0.008 | 0.24 | 0.87 | 0.016 | 0.001 | 0.27 | 40.6 | 15.5 | 8.6 | 2.4 | — (N: 0.027) | | | | |
| 11 | 0.01 | 0.08 | 0.63 | 0.019 | 0.002 | 0.23 | 39.6 | 29.8 | 7.6 | 1.4 | — (N: 0.012) | | | | |
| 12 | 0.005 | 0.19 | 0.98 | 0.026 | 0.001 | 0.33 | 40.3 | 29.2 | 8.1 | — | — (N: 0.027) | | | | |
| 13 | 0.02 | 0.21 | 0.82 | 0.002 | 0.001 | 0.29 | 51.9 | 23.5 | 12.0 | — | — (N: 0.023) | | | | |
| 14 | 0.01 | 0.17 | 0.78 | 0.025 | 01002 | 0.17 | 50.6 | 29.6 | — | 16.2 | — (N: 0.027) | | | | |
| 15 | 0.01 | 0.21 | 0.64 | 0.013 | 0.001 | 0.09 | 48.4 | 16.4 | — | 23.9 | — (N: 0.019) | | | | |
| 16 | 0.01 | 0.12 | 0.74 | 0.026 | 0.003 | 0.24 | 46.1 | 15.6 | 5.3 | 10.1 | — (N: 0.014) | | | | |
| 17 | 0.02 | 0.23 | 0.38 | 0.015 | 0.001 | 0.23 | 45.9 | 20.5 | 8.7 | — | Cu: 1.7 (N: 0.014) | | | 820 | |
| 18 | 0.01 | 0.48 | 0.72 | 0.022 | 0.001 | 0.19 | 54.3 | 21.3 | 10.6 | — | Co: 1.9 (N: 0.015) | | | 870 | |
| 19 | 0.03 | 0.17 | 0.69 | 0.013 | 0.002 | 0.31 | 53.9 | 21.9 | 9.3 | — | La + Ce: 0.019, Y: 0.038 (N: 0.018) | | | 910 | |
| 20 | 0.01 | 0.23 | 0.83 | 0.021 | 0.001 | 0.29 | 57.2 | 18.9 | 10.5 | — | Mg: 0.016 (N: 0.012) | | | 960 | |
| 21 | 0.002 | 0.33 | 0.79 | 0.011 | 0.001 | 0.17 | 41.1 | 19.6 | 9.9 | — | Ca: 0.028 | | | 900 | |
| 22 | 0.01 | 0.28 | 0.75 | 0.021 | 0.001 | 0.19 | 40.9 | 20.4 | 9.2 | — | Ti: 0.31, Mg: 0.008 Y: 0.031 | | | | |
| 23 | 0.01 | 0.29 | 0.88 | 0.014 | 0.002 | 0.14 | 51.6 | 26.8 | 10.3 | — | Cu: 1.6, Ca: 0.028, Ti: 0.04 | | | | |
| 24 | 0.02 | 0.24 | 1.94 | 0.003 | 0.0005 | 0.17 | 49.1 | 27.5 | 9.6 | — | N: 0.26 | | | | |
| 25 | 0.02 | 0.21 | 0.71 | 0.024 | 0.001 | 0.23 | 48.2 | 20.1 | 9.7 | 0.9 | N: 0.17, Cu: 1.7, Co: 1.4 | | | | |
| 26 | 0.009 | 0.27 | 0.76 | 0.017 | 0.0005 | 0.44 | 45.4 | 23.6 | 4.3 | 9.2 | N: 0.10, Ca: 0.017, Y: 0.033 | | | | |
| 27 | 0.01 | 0.14 | 0.94 | 0.014 | 0.001 | 0.31 | 51.9 | 20.5 | 2.6 | 14.2 | N: 0.18, Cu: 1.7, Mg: 0.012 | | | | |
| Comparative | | | | | | | | | | | | | | | |
| 1 | 0.01 | 0.18 | 0.70 | 0.023 | 0.001 | 0.19 | 28.6* | 17.6 | 8.4 | — | — (N: 0.021) | | | | |
| 2 | 0.04 | 0.17 | 0.56 | 0.017 | 0.013* | 0.23 | 41.2 | 30.9* | 8.5 | — | — (N: 0.036) | | | | |
| 3 | 0.01 | 0.11 | 0.79 | 0.010 | 0.003 | 0.08 | 44.3 | 21.6 | 7.6* | — | — (N: 0.020) | | | | |
| 4 | 0.01 | 0.19 | 0.71 | 0.011 | 0.001 | 0.19 | 50.9 | 28.8 | — | 15.0* | — (N: 0.014) | | | | |
| 5 | 0.02 | 0.26 | 0.59 | 0.018 | 0.001 | 0.14 | 40.3 | 20.5 | 6.4 | — | — (N: 0.012) | 950* | 15 | | |
| 6 | | | | | | | | | | | | 1200 | 5* | | |
| 7 | | | | | | | | | | | | | 30 | 750* | |
| 8 | | | | | | | | | | | | | | 900 | 5* |
| 9 | | | | | | | | | | | | | | | 65* |

NOTE:
*outside the range of this invention
**Reduction in thickness for the temperature of 1000° C. and below. Nitrogen amounts within the parentheses are those as an impurity.

TABLE 18

| Alloy No. | Cracking during hot working | Cracking in $H_2S$-10 atm $CO_2$ in 20% NaCl at 300° C. $H_2S$ 0.1 atm | $H_2S$ 1 atm | $H_2S$ 15 atms | 0.2% Offset yield strength (kgf/mm$^2$) | Tensile strength (kgf/mm$^2$) | Elongation (%) | Reduction of area (%) | Impact value (kg.m/cm$^2$ at 0° C.) |
|---|---|---|---|---|---|---|---|---|---|
| This Invention | | | | | | | | | |
| 1 | O | O | O | O | 103.6 | 108.4 | 13 | 64 | 9.8 |
| 2 | | | | | 91.7 | 96.0 | 18 | 77 | 21.2 |
| 3 | | | | | 88.1 | 93.3 | 19 | 78 | 24.2 |
| 4 | | | | | 93.0 | 98.6 | 16 | 73 | 15.7 |
| 5 | | | | | 86.6 | 91.6 | 20 | 81 | 26.8 |
| 6 | | | | | 99.5 | 104.6 | 16 | 73 | 12.4 |
| 7 | | | | | 126.1 | 131.1 | 11 | 52 | 7.0 |
| 8 | | | | | 94.6 | 100.7 | 12 | 64 | 7.8 |
| 9 | | | | | 93.4 | 100.1 | 20 | 79 | 24.3 |
| 10 | | | | | 89.4 | 96.0 | 17 | 73 | 18.7 |
| 11 | | | | | 90.8 | 94.3 | 18 | 70 | 11.7 |
| 12 | | | | | 96.4 | 101.6 | 13 | 49 | 7.6 |
| 13 | | | | | 95.2 | 102.5 | 18 | 71 | 17.3 |
| 14 | | | | | 93.7 | 99.0 | 20 | 78 | 21.4 |
| 15 | | | | | 92.4 | 95.9 | 16 | 73 | 14.5 |
| 16 | | | | | 90.7 | 96.4 | 14 | 67 | 14.1 |

TABLE 18-continued

| Alloy No. | Cracking during hot working | Cracking in $H_2S$-10 atm $CO_2$ in 20% NaCl at 300° C. $H_2S$ 0.1 atm | $H_2S$ 1 atm | $H_2S$ 15 atms | 0.2% Offset yield strength (kgf/mm$^2$) | Tensile strength (kgf/mm$^2$) | Elongation (%) | Reduction of area (%) | Impact value (kg.m/cm$^2$ at 0° C.) |
|---|---|---|---|---|---|---|---|---|---|
| 17 | | | | | 102.2 | 106.3 | 11 | 57 | 6.2 |
| 18 | | | | | 98.1 | 102.5 | 16 | 74 | 16.3 |
| 19 | | | | | 92.7 | 101.1 | 18 | 73 | 16.9 |
| 20 | | | | | 91.2 | 99.4 | 21 | 78 | 23.5 |
| 21 | | | | | 91.8 | 95.6 | 14 | 63 | 9.5 |
| 22 | | | | | 91.2 | 96.5 | 18 | 74 | 14.4 |
| 23 | | | | | 93.4 | 100.6 | 19 | 72 | 12.3 |
| 24 | | | | | 114.6 | 120.1 | 14 | 74 | 11.7 |
| 25 | | | | | 104.1 | 109.3 | 14 | 66 | 12.1 |
| 26 | | | | | 97.3 | 102.5 | 16 | 71 | 16.3 |
| 27 | | | | | 104.4 | 107.9 | 16 | 64 | 11.4 |
| Comparative | | | | | | | | | |
| 1 | | | | X | 85.6 | 87.7 | 14 | 76 | 14.6 |
| 2 | X | — | — | — | — | — | — | — | — |
| 3 | O | O | O | X | 89.2 | 92.1 | 13 | 74 | 12.7 |
| 4 | | | | | 91.4 | 97.3 | 17 | 72 | 13.4 |
| 5 | | | | | 104.4 | 107.1 | 6 | 38 | 2.4 |
| 6 | | | X | | 86.4 | 90.3 | 16 | 78 | 8.6 |
| 7 | X | — | — | — | — | — | — | — | — |
| 8 | O | O | O | X | 53.4 | 78.6 | 28 | 66 | 11.4 |
| 9 | | | | | 129.6 | 134.5 | 4 | 29 | 1.2 |

NOTE:
Alloy Nos. correspond to those of Table 17.

As has been described thoroughly hereinbefore, the production of this invention is superior in its high level of mechanical strength and resistance to stress corrosion cracking and is especially useful for manufacturing casing and/or tubing and/or liners and/or drill pipes for use in deep walls for producing petroleum crude oil, natural gas and geothermal water and other purposes.

What is claimed is:

1. A process for manufacturing high strength deep well casing and tubing having improved resistance to stress corrosion cracking, which comprises preparing an alloy composition which is:

| | | | |
|---|---|---|---|
| C | ≦0.05% | Si | ≦1.0% |
| Mn | ≦2.0% | P | ≦0.030% |
| S | ≦0.005% | N | 0–0.30% |
| Ni | 25–60% | Cr | 15–35% |
| Mo | 0–12% | W | 0–24% |
| Cr (%) + 10Mo (%) + 5W (%) ≧ 50% | | | |
| 1.5% ≦ Mo (%) + ½W (%) ≦ 12% | | | |
| Cu | 0–2.0% | Co | 0–2.0% |
| Rare Earths | 0–0.10% | Y | 0–0.20% |
| Mg 0–0.10% | Ti 0–0.5% | Ca 0–0.10% | |
| and incidental impurities | | balance; | |

applying, after hot working, the solid solution treatment to the alloy at a temperature of from the lower limit temperature (°C.) defined by the following empirical formula: 260 log C(%)+1300 to the upper limit temperature (°C.) defined by the following empirical formula: 16Mo(%)+10W(%)+10Cr(%)+777 for a period of time of not longer than 2 hours; and applying cold working to the resulting alloy with a reduction in thickness of 10–60%.

2. A process as defined in claim 1, in which said hot working is carried out with a reduction in thickness of 10% or more for the temperature range of not higher than the recrystallizing temperature thereof.

3. A process as defined in claim 1, in which said hot working is carried out with a reduction in thickness of 10% or more for the temperature range of not higher than 1000° C. and the finishing temperature is 800° C. or higher.

4. A process as defined in claim 1, in which the sulfur content is not more than 0.0007%.

5. A process as defined in claim 1, in which the phosphorous content is not more than 0.003%.

6. A process as defined in claim 1, in which the nitrogen content is 0.05–0.30%.

7. A process as defined in any one of claims 1–6, in which the Ni content is 35–60%, the Cr content is 22.5–35%, and $$Cr(\%)+10Mo(\%)+5W(\%)\geqq 50\%,$$

$$1.5\%\leqq Mo(\%)+\tfrac{1}{2}W(\%)<4\%.$$

8. A process as defined in any one of claims 1–6, in which the Cr content is 22.5–30%, and $$Cr(\%)+10Mo(\%)+5W(\%)\geqq 70\%$$

$$4\%\leqq Mo(\%)+\tfrac{1}{2}W(\%)<8\%.$$

9. A process as defined in any one of claims 1–6, in which the Ni content is 30–60% and the Cr content is 15–30%, and $$Cr(\%)+10Mo(\%)+5W(\%)\geqq 110\%,$$

$$8\%\leqq Mo(\%)+\tfrac{1}{2}W(\%)\leqq 12\%.$$

10. A process for manufacturing high strength deep well casing and tubing having improved resistance to stress corrosion cracking, which comprises preparing an alloy composition which is:

| | | |
|---|---|---|
| C ≦ 0.05% | | Si ≦ 1.0% |
| Mn ≦ 2.0% | | P ≦ 0.030% |
| S ≦ 0.005% | | N 0–0.30% |
| Ni 25–60% | | Cr 15–35% |
| Mo 0–12% | | W 0–24% |
| Cr (%) + 10Mo (%) + 5W (%) ≧ 50% | | |
| 1.5% ≦ Mo (%) + ½ W (%) ≦ 12% | | |
| Cu 0–2.0% | | Co 0–2.0% |
| Rare Earths 0–0.10% | | Y 0–20% |
| Mg 0–0.10% | Ti 0–0.5% | Ca 0–0.10% |

-continued

| |
|---|
| Fe and incidental impurities: balance, |

applying hot working to the resulting alloy with a reduction in thickness of 10% or more for the temperature range of not higher than 1000° C. and the finishing temperature being 800° or higher, and applying cold working to the resulting hot worked alloy with a reduction in thickness of 10–60%.

11. A process as defined in claim 10, in which prior to the hot working the alloy is heated at a temperature of 1050°–1250° C.

12. A process as defined in claim 10, in which prior to the cold working, the hot rolled alloy is heated at a temperature of from the lower limit temperature (°C.) defined by the following empirical formula:

$$260\log C(\%)+1300$$

to the upper limit temperature (°C.) defined by the following empirical formula:

$$16Mo(\%)+10W(\%)+10Cr(\%)+777$$

for a period of time of not more than 2 hours.

13. A process as defined in claim 10, in which the sulfur content is not more than 0.0007%.

14. A process as defined in claim 10, in which the phosphorous content is not more than 0.003%.

15. A process as defined in claim 1, in which the nitrogen content is 0.05–0.30%.

16. A process as defined in any one of claims 10–15, in which the Ni content is 35–60%, the Cr content is 22.5–35%, and $$Cr(\%)+10Mo(\%)+5W(\%)\geqq 50\%,$$

$$1.5\%\leqq Mo(\%)+\tfrac{1}{2}W(\%)<4\%.$$

17. A process as defined in any one of claims 10–15, in which the Cr content is 22.5–30%, and $$Cr(\%)+10Mo(\%)+5W(\%)\geqq 70\%$$

$$4\%\leqq Mo(\%)+\tfrac{1}{2}W(\%)<8\%.$$

18. A process as defined in any one of claims 10–15, in which the Ni content is 30–60% and the Cr content is 15–30%, and $$Cr(\%)+10Mo(\%)+5W(\%)\geqq 110\%,$$

$$8\%\leqq Mo(\%)+\tfrac{1}{2}W(\%)\leqq 12\%.$$

* * * * *